US008704813B2

(12) United States Patent
Hashimoto et al.

(10) Patent No.: US 8,704,813 B2
(45) Date of Patent: Apr. 22, 2014

(54) INTEGRATED CIRCUIT DEVICE AND ELECTRONIC APPARATUS

(75) Inventors: Keisuke Hashimoto, Chino (JP); Shigeaki Kawano, Chino (JP)

(73) Assignee: Seiko Epson Corporation, Tokyo (JP)

( * ) Notice: Subject to any disclaimer, the term of this patent is extended or adjusted under 35 U.S.C. 154(b) by 129 days.

(21) Appl. No.: 13/222,448

(22) Filed: Aug. 31, 2011

(65) Prior Publication Data

US 2012/0050242 A1 Mar. 1, 2012

(30) Foreign Application Priority Data

Aug. 31, 2010 (JP) ..... 2010-193108

(51) Int. Cl.
*G09G 5/00* (2006.01)
*G09G 3/34* (2006.01)

(52) U.S. Cl.
USPC ..... 345/208; 345/107

(58) Field of Classification Search
USPC ..... 345/33, 60, 87, 94, 107, 204, 208, 21, 345/690, 691, 3
See application file for complete search history.

(56) References Cited

U.S. PATENT DOCUMENTS

2010/0149169 A1* 6/2010 Miyasaka ..... 345/213
2011/0069052 A1 3/2011 Yato et al.
2011/0216104 A1* 9/2011 Chan et al. ..... 345/690

FOREIGN PATENT DOCUMENTS

JP A-4-284491 10/1992
JP A-2002-311887 10/2002
JP A-2008-158243 7/2008
JP A-2009-53639 3/2009
JP A-2011-69894 4/2011

* cited by examiner

*Primary Examiner* — Dwayne Bost
*Assistant Examiner* — Sepehr Azari
(74) *Attorney, Agent, or Firm* — Oliff PLC

(57) ABSTRACT

An integrated circuit device generates drive waveforms which can be adapted to a plurality of panels by a function of setting a repetition period, the function setting which of periods in a drive waveform pattern is to be repeated, and a function of setting the number of times, the function setting what number of times the set period is to be repeated.

10 Claims, 19 Drawing Sheets

| | | Bit | | | | | | | | | | | | | | | |
|---|---|---|---|---|---|---|---|---|---|---|---|---|---|---|---|---|---|
| | | 15 | 14 | 13 | 12 | 11 | 10 | 9 | 8 | 7 | 6 | 5 | 4 | 3 | 2 | 1 | 0 |
| Address | Timing Set | EOW | - | HiZ | TP | BB | BW | WB | WW | Wait Time | | | | | | | |
| 0x00 | T1(RT1) | 0 | - | 0 | 0 | 0 | 0 | 0 | 0 | 0 | 0 | 0 | 0 | 0 | 1 | 0 | 1 |
| 0x02 | T2(RT2) | 0 | - | 0 | 1 | 0 | 0 | 1 | 1 | 1 | 0 | 0 | 0 | 0 | 0 | 1 | 1 |
| 0x04 | T3(RT3) | 0 | - | 0 | 0 | 1 | 1 | 1 | 1 | 1 | 0 | 0 | 0 | 0 | 0 | 1 | 1 |
| 0x06 | T4(RT4) | 0 | - | 0 | 1 | 0 | 0 | 0 | 0 | 1 | 0 | 0 | 0 | 0 | 0 | 1 | 1 |
| 0x08 | T5(RT5) | 0 | - | 0 | 0 | 1 | 0 | 1 | 0 | 1 | 0 | 0 | 0 | 0 | 0 | 1 | 1 |
| 0x0a | T6(RT6) | 1 | - | 0 | 0 | 0 | 0 | 0 | 0 | 0 | 0 | 0 | 0 | 0 | 1 | 0 | 1 |
| 0x0b | T7(RT7) | 0 | - | 0 | 0 | 0 | 0 | 0 | 0 | 0 | 0 | 0 | 0 | 0 | 0 | 0 | 0 |
| 0x0c | T8(RT8) | 0 | - | 0 | 0 | 0 | 0 | 0 | 0 | 0 | 0 | 0 | 0 | 0 | 0 | 0 | 0 |
| 0x0d | T9(RT9) | 0 | - | 0 | 0 | 0 | 0 | 0 | 0 | 0 | 0 | 0 | 0 | 0 | 0 | 0 | 0 |
| 0x0e | T10(RT10) | 0 | - | 0 | 0 | 0 | 0 | 0 | 0 | 0 | 0 | 0 | 0 | 0 | 0 | 0 | 0 |
| 0x0f | T11(RT11) | 0 | - | 0 | 0 | 0 | 0 | 0 | 0 | 0 | 0 | 0 | 0 | 0 | 0 | 0 | 0 |
| 0x10 | T12(RT12) | 0 | - | 0 | 0 | 0 | 0 | 0 | 0 | 0 | 0 | 0 | 0 | 0 | 0 | 0 | 0 |

30A

FIG. 6A

| Wait Time | | |
|---|---|---|
| D[7-4] | D[3-0] | Time[mS] |
| 0 | 5 | 4.88 |
| 8 | 3 | 127.93 |
| 8 | 3 | 127.93 |
| 8 | 3 | 127.93 |
| 8 | 3 | 127.93 |
| 0 | 5 | 4.88 |
| 0 | 0 | 0.00 |
| 0 | 0 | 0.00 |
| 0 | 0 | 0.00 |
| 0 | 0 | 0.00 |
| 0 | 0 | 0.00 |
| 0 | 0 | 0.00 |

FIG. 6B

| | | Bit | | | | | | | | | | | | | | | |
|---|---|---|---|---|---|---|---|---|---|---|---|---|---|---|---|---|---|
| | | 15 | 14 | 13 | 12 | 11 | 10 | 9 | 8 | 7 | 6 | 5 | 4 | 3 | 2 | 1 | 0 |
| Address | Timing Set | EOW | - | HiZ | TP | BB | BW | WB | WW | Wait Time | | | | | | | |
| 0x00 | T1(RT1) | 0 | - | 0 | 0 | 0 | 0 | 0 | 0 | 0 | 0 | 0 | 0 | 0 | 1 | 0 | 1 |
| 0x02 | T2(RT2) | 0 | - | 0 | 0 | 0 | 1 | 0 | 1 | 1 | 1 | 1 | 1 | 0 | 0 | 1 | 1 |
| 0x04 | T3(RT3) | 0 | - | 0 | 1 | 0 | 0 | 0 | 0 | 1 | 1 | 1 | 1 | 0 | 0 | 1 | 1 |
| 0x06 | T4(RT4) | 0 | - | 0 | 0 | 1 | 0 | 1 | 0 | 1 | 1 | 1 | 1 | 0 | 0 | 1 | 1 |
| 0x08 | T5(RT5) | 1 | - | 0 | 0 | 0 | 0 | 0 | 0 | 0 | 0 | 0 | 0 | 0 | 1 | 0 | 1 |
| 0x0a | T6(RT6) | 0 | - | 0 | 0 | 0 | 0 | 0 | 0 | 0 | 0 | 0 | 0 | 0 | 0 | 0 | 0 |
| 0x0b | T7(RT7) | 0 | - | 0 | 0 | 0 | 0 | 0 | 0 | 0 | 0 | 0 | 0 | 0 | 0 | 0 | 0 |
| 0x0c | T8(RT8) | 0 | - | 0 | 0 | 0 | 0 | 0 | 0 | 0 | 0 | 0 | 0 | 0 | 0 | 0 | 0 |
| 0x0d | T9(RT9) | 0 | - | 0 | 0 | 0 | 0 | 0 | 0 | 0 | 0 | 0 | 0 | 0 | 0 | 0 | 0 |
| 0x0e | T10(RT10) | 0 | - | 0 | 0 | 0 | 0 | 0 | 0 | 0 | 0 | 0 | 0 | 0 | 0 | 0 | 0 |
| 0x0f | T11(RT11) | 0 | - | 0 | 0 | 0 | 0 | 0 | 0 | 0 | 0 | 0 | 0 | 0 | 0 | 0 | 0 |
| 0x10 | T12(RT12) | 0 | - | 0 | 0 | 0 | 0 | 0 | 0 | 0 | 0 | 0 | 0 | 0 | 0 | 0 | 0 |

30A

FIG. 8A

| Wait Time | | |
|---|---|---|
| D[7-4] | D[3-0] | Time[mS] |
| 0 | 5 | 4.88 |
| 15 | 3 | 237.30 |
| 15 | 3 | 237.30 |
| 15 | 3 | 237.30 |
| 0 | 5 | 4.88 |
| 0 | 0 | 0.00 |
| 0 | 0 | 0.00 |
| 0 | 0 | 0.00 |
| 0 | 0 | 0.00 |
| 0 | 0 | 0.00 |
| 0 | 0 | 0.00 |
| 0 | 0 | 0.00 |

FIG. 8B

| Resister Name | Address | Bit | Function | Setting |
|---|---|---|---|---|
| EPD Waveform Loop range Register | 0x5608 | D15-13 | – | – |
| | | D12-8 | Timing set # of loop | 0 to 31 |
| | | D7-5 | – | – |
| | | D4-0 | Timing set # of loop end | 0 to 31 |
| EPD Waveform Loop count Register | 0x560a | D15-8 | – | – |
| | | D7-0 | Loop counter | 0 to 255 |

30B

FIG. 11A

| Resister Name | Address | Bit | Function | Setting |
|---|---|---|---|---|
| EPD Waveform Loop range 1 Register | 0x5608 | D15-13 | – | – |
| | | D12-8 | Timing set # of loop | 0 to 31 |
| | | D7-5 | – | – |
| | | D4-0 | Timing set # of loop end | 0 to 31 |
| EPD Waveform Loop count 1 Register | 0x560a | D15-8 | – | – |
| | | D7-0 | Loop counter 1 | 0 to 255 |
| EPD Waveform Loop range 2 Register | 0x560c | D15-13 | – | – |
| | | D12-8 | Timing set # of loop | 0 to 31 |
| | | D7-5 | – | – |
| | | D4-0 | Timing set # of loop end | 0 to 31 |
| EPD Waveform Loop count 2 Register | 0x560e | D15-8 | – | – |
| | | D7-0 | Loop counter 2 | 0 to 255 |

30B

FIG. 11B

| | | Bit | | | | | | | | | | | | | | | | | | | | | | | | | | | | | | | |
|---|---|---|---|---|---|---|---|---|---|---|---|---|---|---|---|---|---|---|---|---|---|---|---|---|---|---|---|---|---|---|---|---|---|
| | | 31 | 30 | 29 | 28 | 27 | 26 | 25 | 24 | 23 | 22 | 21 | 20 | 19 | 18 | 17 | 16 | 15 | 14 | 13 | 12 | 11 | 10 | 9 | 8 | 7 | 6 | 5 | 4 | 3 | 2 | 1 | 0 |
| Address | Timing Set | EOW | - | HiZ | TP | BB | BW | WB | WW | Wait Time | | | | | | | | Loop Count | | | | | | | | - | | | Jump to | | | | |
| 0x00 | T1(RT1) | 0 | - | 0 | 0 | 0 | 0 | 0 | 0 | 0 | 0 | 0 | 0 | 0 | 1 | 0 | 1 | 0 | 0 | 0 | 0 | 0 | 0 | 0 | 0 | - | - | - | 0 | 0 | 0 | 0 | 0 |
| 0x04 | T2(RT2) | 0 | - | 0 | 1 | 1 | 0 | 1 | 1 | 0 | 1 | 1 | 1 | 1 | 1 | 0 | 1 | 0 | 0 | 0 | 0 | 0 | 0 | 0 | 0 | - | - | - | 0 | 0 | 0 | 0 | 0 |
| 0x08 | T3(RT3) | 0 | - | 0 | 0 | 0 | 1 | 1 | 0 | 0 | 1 | 1 | 1 | 1 | 1 | 0 | 1 | 0 | 0 | 0 | 0 | 0 | 0 | 0 | 0 | - | - | - | 0 | 0 | 0 | 0 | 0 |
| 0x0c | T4(RT4) | 0 | - | 0 | 1 | 1 | 0 | 0 | 1 | 0 | 1 | 1 | 1 | 1 | 1 | 0 | 1 | 0 | 0 | 0 | 0 | 0 | 0 | 0 | 0 | - | - | - | 0 | 0 | 0 | 0 | 0 |
| 0x10 | T5(RT5) | 0 | - | 0 | 0 | 0 | 0 | 1 | 0 | 0 | 1 | 1 | 1 | 1 | 1 | 0 | 1 | 0 | 0 | 0 | 0 | 0 | 0 | 0 | 0 | - | - | - | 0 | 0 | 0 | 0 | 0 |
| 0x14 | T6(RT6) | 0 | - | 0 | 0 | 0 | 0 | 0 | 0 | 0 | 1 | 1 | 1 | 1 | 1 | 0 | 1 | 0 | 0 | 0 | 0 | 0 | 0 | 1 | 1 | - | - | - | 0 | 0 | 1 | 0 | 0 |
| 0x18 | T7(RT7) | 1 | - | 0 | 0 | 0 | 0 | 0 | 0 | 0 | 0 | 0 | 0 | 0 | 1 | 0 | 1 | 0 | 0 | 0 | 0 | 0 | 0 | 1 | 0 | - | - | - | 0 | 0 | 0 | 1 | 0 |

30A 30B

FIG. 16

INTEGRATED CIRCUIT DEVICE AND ELECTRONIC APPARATUS

The entire disclosure of Japanese Patent Application No. 2010-193108, filed Aug. 31, 2010, is expressly incorporated by reference herein.

BACKGROUND

1. Technical Field

An aspect of the present invention relates to an integrated circuit device, an electronic apparatus.

2. Related Art

Heretofore, an integrated circuit device which drives an electro-optical panel such as an EPD (Electrophoretic Display) panel has been known. For example, as the related art of the EPD panel, there is a technique disclosed in JP-A-2009-53639.

In driving of such an EPD panel (electrophoretic panel), a drive voltage is sequentially changed in some cases. In this case, an integrated circuit device such as a display driver which drives the EPD panel supplies the EPD panel with a sequentially changing drive voltage.

However, when a control device such as an MPU disposed at the outside of the integrated circuit device executes an instruction to select the sequentially changing drive voltage, the processing load of the control device is increased.

The EPD panel, an ECD (Electrochromic Display) panel, an NCD (Nanochromics Display) panel, and the like can also be referred to as an electronic paper panel. Various driving methods exist according to the type and the like of the electronic paper panel (electro-optical panel in a broad sense).

SUMMARY

According to an advantage of some aspects of the invention, it is possible to provide an integrated circuit device which is easily adapted to a plurality of driving methods, an electronic apparatus, and the like.

An aspect of the invention relates to an integrated circuit device including: a drive voltage output section which outputs a drive voltage to be supplied to a segment electrode of an electro-optical panel; a display data storage section which stores at least first display data and second display data; and a drive waveform information output section which outputs drive waveform information in changing of a display state at the segment electrode from a first display state corresponding to the first display data to a second display state corresponding to the second display data, wherein the drive waveform information output section has a first storage section which stores the drive waveform information for each of basic periods T1 to TM (M is an integer of 2 or more), a second storage section which stores a first designated period where at least one of the basic periods T1 to TM is designated and a first number of times of repetition of the first designated period, and an output section which outputs the drive waveform information corresponding to each period specified by the basic periods T1 to TM, the first designated period, and the first number of times of repetition, and the drive voltage output section outputs the drive voltage specified by the first display data and the second display data from the display data storage section and the drive waveform information from the drive waveform information output section.

According to the aspect of the invention, the drive waveform information is stored for each of the basic periods T1 to TM. In addition, at least one of the basic periods T1 to TM is set as the first designated period, and the drive waveform information of the first designated period can be repeated the first number of times of repetition to be output. Accordingly, since it is sufficient to store the drive waveform information for the basic periods T1 to TM, drive waveform information is easily generated and is easily adapted to a plurality of driving methods by repeating a part of periods. In addition, since it is sufficient to store the drive waveform information for the basic periods T1 to TM, the storage capacity can be reduced.

Moreover, the drive voltage is specified by the first and second display data and the drive waveform information in changing of the display state from the first display state corresponding to the first display data to the second display state corresponding to the second display data, and the electro-optical panel is driven by the specified drive voltage. By doing this, in changing (transition) of the display state from the first display state to the second display state, the drive voltage can be automatically changed sequentially, and therefore, a reduction in the processing load of a control device, and the like can be realized.

In one aspect of the invention, the drive waveform information may include N×N (N is an integer of 2 or more) drive waveform signals SWV (1, 1) to SWV (N, N), the first storage section may have registers RT1 to RTM (M is an integer of 2 or more) corresponding to the basic periods T1 to TM, respectively, the register RTk ($1 \le k \le M$) of the registers RT1 to RTM may store a register value specifying signal levels of the drive waveform signals SWV (1, 1) to SWV (N, N) in the basic period Tk of the basic periods T1 to TM, and the second storage section may store, as the first designated period, a starting period and an ending period of the basic periods T1 to TM.

By doing this, the starting and ending periods of the first designated period can be selected from the basic periods T1 to TM. Moreover, when the display state changes from the first display state to the second display state, the drive waveform signals SWV (1, 1) to SWV (N, N) can be prepared. The signal levels of the drive waveform signals SWV (1, 1) to SWV (N, N) in each basic period can be set with register values to change the drive waveform signals SWV (1, 1) to SWV (N, N). Accordingly, according to the driving method, display characteristics, and the like of the electro-optical panel, the drive waveform signals SWV (1, 1) to SWV (N, N) of various waveforms can be generated.

In one aspect of the invention, the second storage section may have a first register which stores the starting period, a second register which stores the ending period, and a third register which stores the first number of times of repetition.

Alternatively, the second storage section may have a first register which stores the starting period and the ending period and a second register which stores the first number of times of repetition. In this case, the first register has an area for storing information of first and second bit strings, the first bit string corresponding to the starting period, the second bit string corresponding to the ending period.

In this manner, by adding registers for a repetitive output operation in addition to the registers RT1 to RTM for storing signal levels, a waveform in a part of periods can be repeatedly output.

In one aspect of the invention, the second storage section may be disposed in the registers RT1 to RTM. In this case, the register RTk ($1 \le k \le M$) of the registers RT1 to RTM can have an area for storing the register value specifying the signal levels, the starting period and the ending period of the basic periods T1 to TM indicating the first designated period, and the first number of times of repetition.

By doing this, the first and second storage sections can be disposed indifferent areas of the registers RT1 to RTM.

In one aspect of the invention, the register RTk can have an area for storing information of first to third bit strings, the first bit string corresponding to the register value specifying the signal levels, the second bit string corresponding to the first number of times of repetition, the third bit string corresponding to the starting period, and the register RTk in which the first number of times of repetition and the starting period are designated by the second and third bit strings can designate the basic period Tk corresponding to the register RTk as the ending period.

In this manner, a plurality of pieces of information required can be separately stored with the respective bit strings. In addition, the register RTk itself having effective bits in the second and third bit strings can represent an ending period, so that a bit string for the ending period can be unnecessary.

In one aspect of the invention, the second storage section may further store a second designated period different from the first designated period and a second number of times of repetition of the second designated period, and the output section may output the drive waveform information in each period specified by the basic periods T1 to TM, the first designated period, the first number of times of repetition, the second designated period, and the second number of times of repetition.

By doing this, not only the first designated period but also the second designated period can be used, so that various drive waveform information can be generated by the combination of the repetition of the first designated period and the repetition of the second designated period.

Here, the first and second designated periods different from each other can include the case where none of the basic periods T1 to TM overlap, the case where any one of the basic periods T1 to TM overlaps partially, and the case where one of the entire first and second designated periods overlaps the other period partially.

In one aspect of the invention, the second designated period may be set within the first designated period, and the second designated period may be repeated the second number of times of repetition in each of the first designated periods corresponding to the first number of times of repetition.

By doing this, the second designated period is incorporated into the first designated period. In addition, it is possible to output drive waveform information in which the second designated period is incorporated the second number of times of repetition in each of the first designated periods corresponding to the first number of times of repetition.

In one aspect of the invention, when the second designated period is set within the first designated period, subtraction may be performed for the second number of times of repetition stored in the second storage section every time the second designated period is repeated.

By doing this, when the second designated period is incorporated the second number of times of repetition into the first designated period at a first time, the second number of times of repetition is reduced to zero. Therefore, the second designated period is repeated the second number of times of repetition only within the first designated period at a first time.

In this manner, the second designated period is not incorporated into the first designated period at a second time or later. By doing this, the first designated period can be independent of the second designated period.

Another aspect of the invention relates to an electronic apparatus including: the integrated circuit device according to any of the aspects of the invention described above; and the electro-optical panel.

BRIEF DESCRIPTION OF THE DRAWINGS

The invention will be described with reference to the accompanying drawings, wherein like numbers reference like elements.

FIGS. 6A and 6B show a setting example of register values for generating drive waveforms.

FIGS. 8A and 8B show a setting example of register values for generating drive waveforms.

FIGS. 11A and 11B each show a modified example of registers RL1 to RL3 in FIG. 9.

FIG. 16 shows a setting example of register values for generating drive waveforms and register values for loop control.

DESCRIPTION OF EXEMPLARY EMBODIMENTS

Hereinafter, a preferred embodiment of the invention will be described in detail. The embodiment described below does not unduly limit the contents of the invention set forth in the appended claims. Also, not all the configurations described in the embodiment are essential as means for implementing the invention.

1. Configuration

Figure 1:
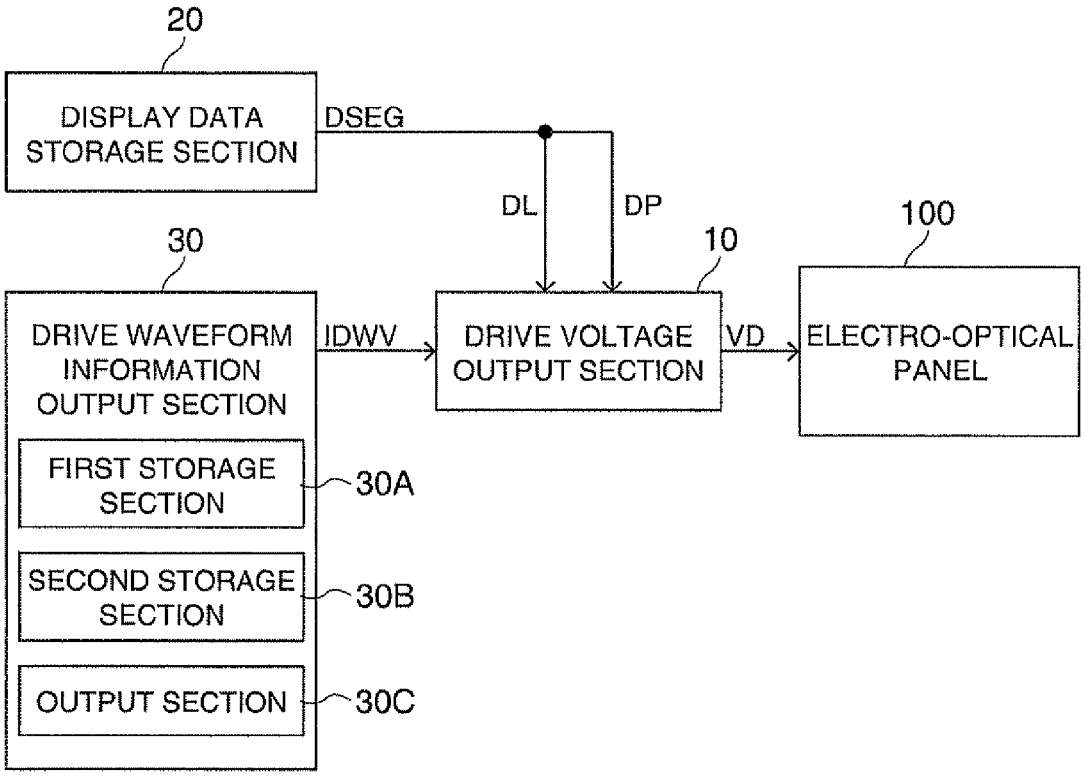
FIG. 1 is a configuration example of an integrated circuit device of an embodiment.

FIG. 1 shows a configuration example of an integrated circuit device of the embodiment. The integrated circuit device of the embodiment has a function of generating drive waveforms for driving an electro-optical panel 100. Specifically, the integrated circuit device has a function of generating sequential drive waveforms necessary for changing the display of the electro-optical panel 100. Waveform information for generating the drive waveforms is stored in, for example, a programmable storage section (nonvolatile memory, ROM, register, etc.), and the drive waveform generating function is realized by the waveform information stored in the programmable storage section.

For realizing such a drive waveform generating function, the integrated circuit device of the embodiment has a drive voltage output section 10, a display data storage section 20, and a drive waveform information output section 30.

The display data storage section 20 and the drive waveform information output section 30 may constitute the integrated circuit device.

When taking an EPD (Electrophoretic Display) panel as an example, the electro-optical panel 100 can include a substrate, a counter substrate, and an electrophoretic layer disposed between the substrate and the counter substrate. The electrophoretic layer (electrophoretic sheet) is composed of numerous microcapsules including electrophoretic materials. The microcapsule is realized by, for example, dispersing positively charged black particles (electrophoretic materials) and negatively charged white particles (electrophoretic materials) into a dispersion liquid and encapsulating the dispersion liquid in a fine capsule.

When taking a passive EPD panel as an example, a segment electrode (drive electrode, pixel electrode), for example, is disposed on the substrate formed of glass or a transparent resin. On the counter substrate (electrophoretic sheet), a top plane electrode (common electrode) is disposed. The electrophoretic sheet may be formed by forming the top plane electrode on a transparent resin layer using a transparent conductive material and by coating an adhesive or the like onto the top plane electrode to adhere the electrophoretic layer.

When an electric field is applied between the segment electrode and the top plane electrode, an electrostatic force is exerted on the positively charged particles (black) and the negatively charged particles (white) which are encapsulated in the microcapsule, in the direction according to the positive or negative state of the charged particles. For example, when the segment electrode has a potential higher than that of the top plane electrode, since the positively charged particles (black) are moved toward the top plane electrode, black is displayed at the pixel. Meanwhile, when the top plane electrode has a potential higher than that of the segment electrode, white is displayed.

The electro-optical panel 100 is not limited to the EPD panel and may be an EGO (Electrochromic Display) panel or the like. The ECD panel realizes a display operation by using a phenomenon in which when a voltage is applied, a material is colored through an oxidation-reduction reaction or a light transmittance is changed.

The electro-optical panel 100 may be an electronic paper panel such as an ECD (Electrochromic Display) panel or an NCD (Nanochromics Display) panel. Various driving methods exist according to the type and the like of the electro-optical panel. An integrated circuit device which is easily adapted to a plurality of driving methods will be described also in "4. Drive Waveform Information Output Section".

The drive voltage output section 10 (drive section) outputs a drive voltage VD (drive signal) to be supplied to the electro-optical panel 100. For example, the drive voltage output section 10 outputs the drive voltage VD to be supplied to the segment electrode (icon electrode, drive electrode, pixel electrode) of the electro-optical panel 100. Thus, driving of the passive EPD panel or the like can be realized.

The display data storage section 20 (image data storage section) stores display data DSEG (image data). The display data storage section 20 can be realized by a register composed of a flip-flop or the like, or a memory such as an SRAM.

The drive waveform information output section 30 outputs drive waveform information IDWV (drive waveform pattern information, drive voltage information). For example, the drive waveform information output section 30 outputs the drive waveform information IDWV in changing of the display state (grayscale) at the segment electrode of the electro-optical panel 100 from a first display state (first grayscale; one of white display and black display) corresponding to first display data DL to a second display state (second grayscale; the other of the white display and the black display) corresponding to second display data DP. Here, for example, the first display data DL is previous display data, and the second display data DP is present display data. The drive waveform information IDWV is information which defines change in drive waveform between the first and second display states when the display state changes from, for example, the first display state to the second display state. For example, the drive voltage VD in each of a plurality of changing periods is specified by the drive waveform information IDWV.

The drive voltage VD may have two values (for example, 0 V, 15 V) or three values (for example, 0 V, +15 V, −15 V, or 0 V, 15 V, 30 V). Alternatively, the drive voltage VD may have four values or more. Moreover, the drive voltage VD can employ various values according to the type and the like of the electro-optical panel 100.

By controlling the length of a period for applying the drive voltage VD (for example, 15 V), the amount of current flowing through the segment electrode may be controlled. The method for applying the drive voltage VD can employ various methods according to the type and the like of the electro-optical panel 100.

In the embodiment, the drive waveform information output section 30 can include a first storage section 30A, a second storage section 30B, and an output section 30C. The first storage section 30A stores the drive waveform information IDWV for each of basic periods T1 to TM (M is an integer of 2 or more). The second storage section 30B stores a first designated period where at least one of the basic periods T1 to TM is designated and a first number of times of repetition of the first designated period. The output section 30C outputs the drive waveform information IDWV corresponding to each period specified by the basic periods T1 to TM, the first designated period, and the first number of times of repetition.

The drive voltage output section 10 outputs the drive voltage VD specified by the first display data DL and the second display data DP, which are the display data DSEG (segment data) output from the display data storage section 20, and the drive waveform information IDWV from the drive waveform information output section 30. For example, the drive voltage output section 10 selects, based on the first and second display data DL and DP, an output drive waveform signal from a plurality of drive waveform signals of the drive waveform information IDWV, and outputs the drive voltage VD specified (set) by the selected output drive waveform signal to the segment electrode of the electro-optical panel 100.

Figure 2A:
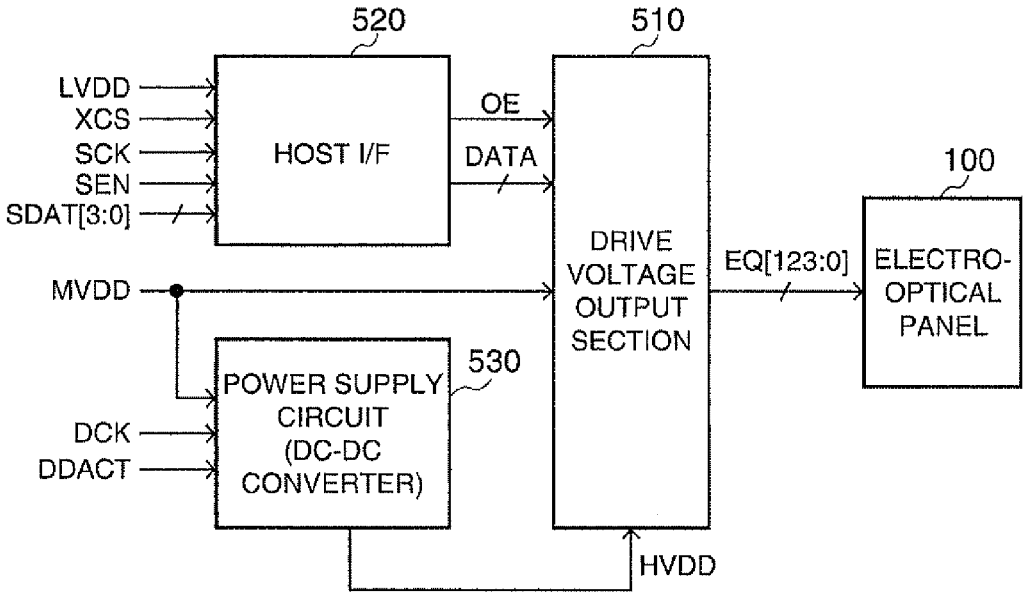
FIGS. 2A to 2C are explanatory views of integrated circuit devices of first and second comparative examples.

FIG. 2A shows a configuration example of an integrated circuit device of a first comparative example of the embodiment. The integrated circuit device includes a drive voltage output section 510, a host I/F (interface) 520, and a power supply circuit 530 (DC-DC converter).

The drive voltage output section 510 outputs a drive voltage having two values or three values through terminals EQ[123:0] thereof for directly driving the electro-optical panel 100 such as the passive EPD panel. For example, in the case of binary driving, the drive voltage output section 510 outputs any of 0 V (=GND) and 15 V.

The power supply circuit 530 (DC-DC converter) boosts an external power supply voltage MVDD to generate a drive power supply voltage HVDD. For example, when the external power supply voltage MVDD is a power supply voltage of 3 V from a lithium battery, the power supply circuit 530 performs sextuple boosting by a charge pump scheme to generate the drive power supply voltage HVDD of about 15 to 18 V, and supplies the drive voltage output section 510 with the generated drive power supply voltage HVDD. Thus, the binary driving of 0 V and 15 V is possible. By considering the fact that a voltage drop occurs due to the influence of the driving load of the EPD, the power supply circuit 530 generates a voltage of 18 V higher than 15 V. Moreover, the drive power supply voltage HVDD may be supplied externally.

The drive voltage output section 510 is supplied with the drive power supply voltage HVDD from the power supply circuit 530, selects any of the drive voltages of 0 V and 15 V, and outputs the selected voltage to the terminals EQ[123:0] to drive the segment electrode of the electro-optical panel 100. The function of selecting the drive voltage is realized by the host I/F 520 (MPU I/F).

For example, the host I/F 520 is supplied with a logic power supply voltage LVDD. From an external control device such as an MPU (MCU), a chip select signal XCS, a serial clock SCK, an output enable signal SEN, and data SDAT[3:0] are input to the host I/F 520. In this case, meaning is imparted to data such that a logic level "0" represents 0 V-driving and a logic level "1" represents 15 V-driving, and drive information (0 V, 15 V) of each of the driver terminals EQ[123:0] is received from the external control device via the host I/F 520. Then, as shown in FIG. 2B, on-off control for the output of the drive voltage from the terminals EQ[123:0] is performed based on the output enable signal SEN.

Figure 2B:
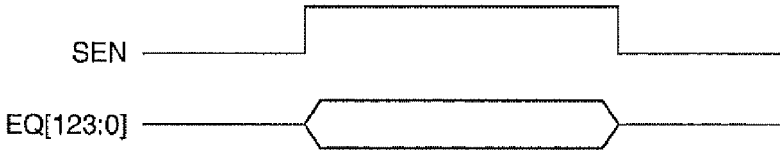
Figure 2C:
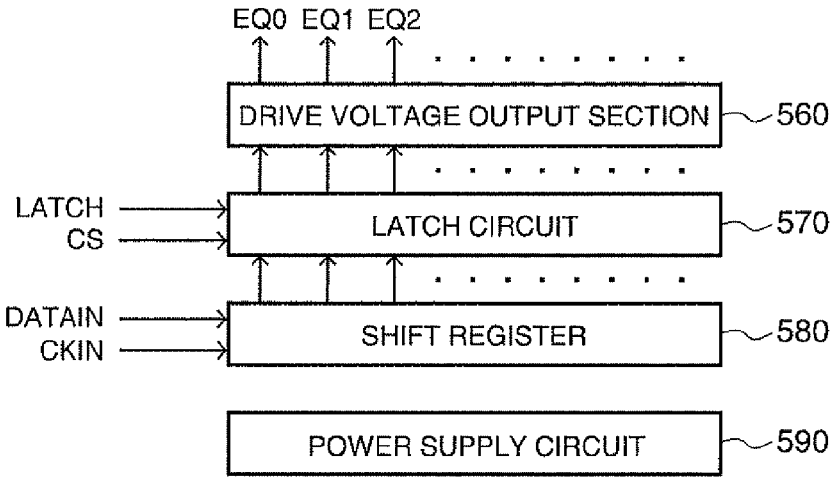

FIG. 2C shows a configuration example of an integrated circuit device of a second comparative example of the embodiment. The integrated circuit device includes a drive voltage output section 560, a latch circuit 570, a shift register 580, and a power supply circuit 590 (DC-DC converter). DATAIN serially input from an external control device is input to the shift register 580 in synchronization with a clock CKIN. Then, when data corresponding to all driver terminals EQ1, EQ2, . . . is input to the shift register 580 as drive information, the drive information is latched by the latch circuit 570 based on a latch signal LATCH. A drive voltage of 0 V or 15 V corresponding to the latched drive information is output from the drive voltage output section 560 to the driver terminals EQ1, EQ2, . . . , so that the segment electrode of the electro-optical panel is driven. After the latching of the drive information by the latch circuit 570, the next data is input to the shift register 580, drive information from the shift register 580 is latched by the latch circuit 570 again, and a drive voltage of 0 V or 15 V is output to the driver terminals EQ1, EQ2, . . . .

In the first and second comparative examples of FIGS. 2A to 2C as described above, the external control device such as an MPU performs the sequential repetition process, whereby a drive waveform necessary for changing the display of the EPD panel is generated. Specifically, when a drive waveform is sequentially changed for changing the display state from the first display state (for example, the black display) to the second display state (for example, the white display), the control device performs a process of inputting data to the host I/F or the shift register in each of a plurality of sequentially changing periods and rendering the output enable signal active (H level). For example, in the case of changing a drive waveform 10 times, the control device repeats the process of inputting data and rendering the output enable signal active 10 times. Accordingly, the processing load of the control device may be increased, causing a problem such as obstacles to other processes.

On the other hand, in the integrated circuit device of the embodiment in FIG. 1, the sequential drive waveform necessary for changing the display of the electro-optical panel 100 is automatically generated. That is, the drive waveform information output section 30 outputs, as the drive waveform information IDWV, drive waveforms corresponding to a plurality of periods in changing of the display from the first display state (for example, the black display) to the second display state (for example, the white display). Then, the drive voltage output section 10 outputs the drive voltage VD corresponding to the plurality of periods based on the previous display data DL corresponding to the first display state, the present display data DP corresponding to the second display state, and the drive waveform information IDWV. Accordingly, the control device such as an MPU does not need to repeatedly execute the process of inputting drive information data or the process of rendering the output enable signal active. For example, the control device simply inputs a set of the second display data and a trigger signal, so that the sequential drive waveform for changing the display from the first display state to the second display state is automatically generated. Accordingly, the processing load of the control device can be significantly reduced as compared with the first and second comparative examples shown in FIGS. 2A and 2C.

In addition, the embodiment does not only output sequentially the drive waveform information IDWV of the basic periods T1 to TM stored in the first storage section 30A; the embodiment can also designate to repeat the drive waveform information IDWV within the first designated period the number of times designated to sequentially output the drive waveform information, based on the first designated period where at least one of the basic periods T1 to TM is designated and the number of times of repetition (first number of times of repetition) of the first designated period.

2. Detailed Configuration

Figure 3:
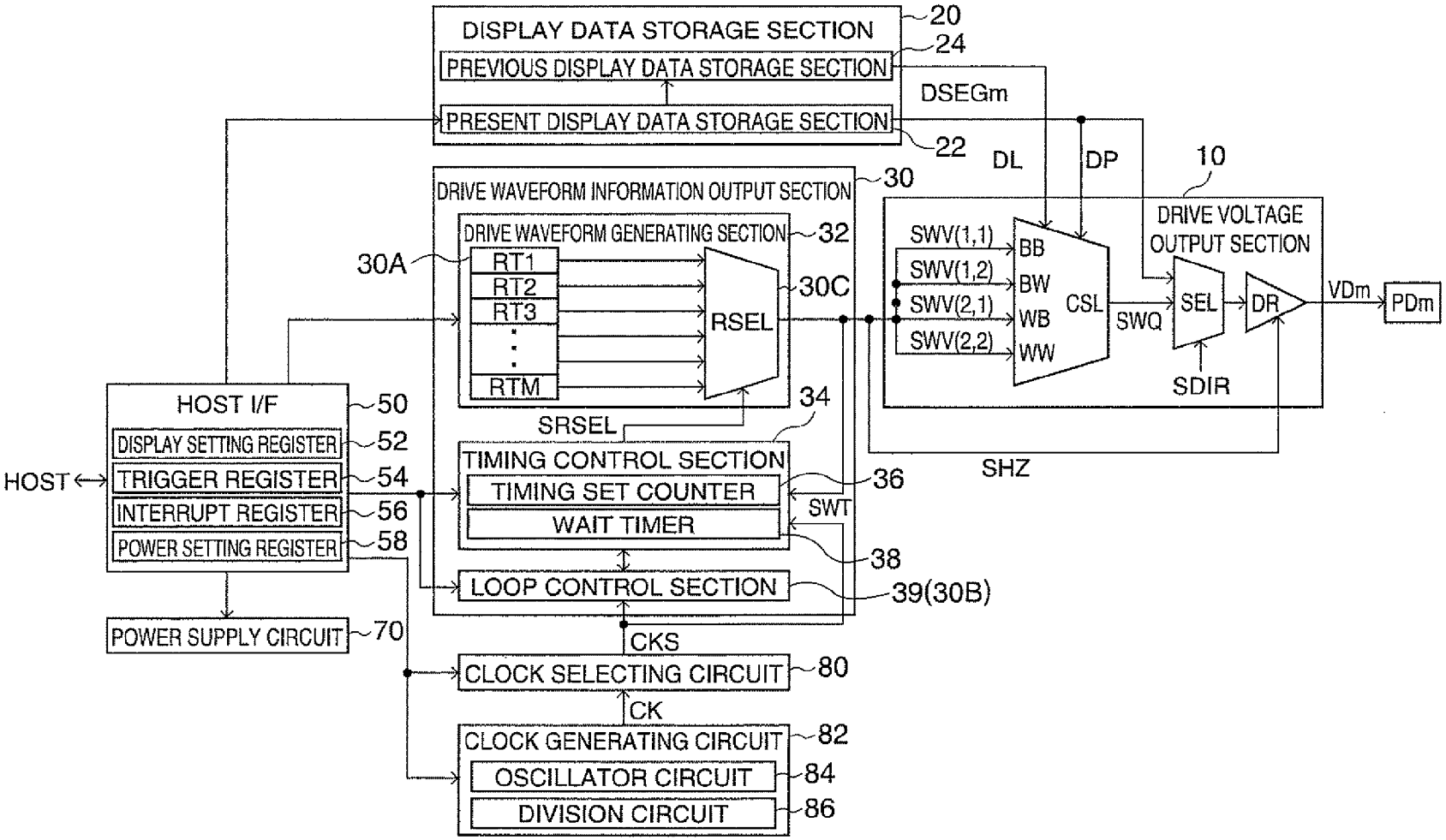
FIG. 3 is a detailed configuration example of the integrated circuit device of the embodiment.

FIG. 3 shows a detailed configuration example of the integrated circuit device of the embodiment. The integrated circuit device includes a host I/F (interface) 50 in addition to the drive voltage output section 10, the display data storage section 20, and the drive waveform information output section 30. Moreover, the integrated circuit device can include a power supply circuit 70, a clock selecting circuit 80, and a clock generating circuit 82. Various modifications such as omission of a part of these constituent elements and addition of other constituent elements can be made.

In the configuration example of FIG. 3, the drive waveform information output section 30 outputs four (=2×2, N×N in a broad sense; N is an integer of 2 or more) drive waveform signals SWV (1, 1) to SWV (2, 2) (SWV (1, 1) to SWV (N, N) in a broad sense). Here, the drive waveform signal SWV (i, j) of the drive waveform signals SWV (1, 1) to SWV (2, 2) is a drive waveform signal representing that the first display state is an i state ($1 \le i \le N$) and the second display state is a j state ($1 \le j \le N$).

For example, the first display state includes two states of black display and white display, and the second display state also includes the two states of black display and white display. The signal SWV (1, 1) is a drive waveform signal representing that both the first and second display states are the black display (B), and the signal SWV (1, 2) is a drive waveform signal representing that the first display state is the black display (B) and the second display state is the white display (W). Similarly, the signal SWV (2, 1) is a drive waveform signal representing that the first display state is the white display (W) and the second display state is the black display (B), and the signal SWV (2, 2) is a drive waveform signal representing that both the first and second display states are the white display (W).

The drive voltage output section 10 selects, based on the first display data DL and the second display data DP, an output drive waveform signal SWQ from the drive waveform signals SWV (1, 1) to SWV (2, 2). Then, the drive voltage output section 10 outputs a voltage specified by the output drive waveform signal SWQ as a drive voltage VDm.

For example, when the first display data DL corresponding to the first display state is black display data and the second display data DP corresponding to the second display state is black display data, the drive waveform signal SWV (1, 1) is selected. When the first display data DL is black display data and the second display data DP is white display data, the drive waveform signal SWV (1, 2) is selected. Similarly, when the first display data DL is white display data and the second display data DP is black display data, the drive waveform signal SWV (2, 1) is selected. When both the first and second display data DL and DP are white display data, the drive waveform signal SWV (2, 2) is selected.

In the above description, the case where each of the first and second display states has two grayscales (two states) of black display and white display has been described. However, each state may have three grayscales or more. For example, when each state has N grayscales, the drive waveform information output section 30 outputs N×N drive waveform signals SWV (1, 1), SWV (1, 2), . . . , SWV (1, N), SWV (2, N), SWV (3, N), . . . , SWV (N, N).

The drive voltage output section 10 includes a drive circuit DR, a selector SEL, and a drive waveform selecting circuit CSL. The drive circuit DR outputs the drive voltage VDm of two values such as 0 V and 15 V, for example. The drive voltage VDm is output to the electro-optical panel via a pad PDm (terminal) of the integrated circuit device, so that the segment electrode of the electro-optical panel is driven.

The pad PDm (terminal) of the integrated circuit device can also be referred to as an output terminal of the drive circuit DR.

The drive voltage VDm may have three values or more, and the value of the drive voltage VDm is appropriately set according to the type of the electro-optical panel (EPD panel, ECD panel). Moreover, for example, a level shifter is disposed in the drive circuit DR. The level shifter uses a drive power supply voltage (for example, 15 V) from the power supply circuit 70 to convert the voltage level (for example, 3 V) of the output drive waveform signal SWQ to the voltage level (for example, 15 V) of the drive voltage VDm.

Moreover, when a setting signal SHZ for a high impedance state from the drive waveform information output section 30 becomes active, the drive circuit DR sets the output terminal thereof to the high impedance state. Thus, on-off control for driving the segment electrode is possible. Such an on-off control function for driving is provided because the high impedance state may also be necessary, as well as a specific drive voltage of only two values or three values, in the course of a drive sequence according to the type of the EPD panel or ECD panel.

The selector SEL is a circuit for performing switching between a sequential mode and a direct mode. For example, when a direct mode selecting signal SDIR becomes active, an operation mode is set to the direct mode, and the signal of the display data DP from a present display data storage section 22 is selected to be output to the drive circuit DR. Thus, like the comparative example of FIG. 2A, the direct mode in which the external control device such as an MPU directly performs setting of a sequential drive voltage is realized.

Meanwhile, when the signal SDIR becomes non-active, the output drive waveform signal SWQ from the drive waveform selecting circuit CSL is selected to be output to the drive circuit DR. Thus, the sequential mode in which a sequential drive waveform is automatically generated by the integrated circuit device is realized.

The drive waveform selecting circuit CSL selects, based on the display data DL and DP from the display data storage section 20, any of the drive waveform signals SWV (1, 1) to SWV (2, 2) output by the drive waveform information output section 30 as the drive waveform information, and outputs the selected one as the output drive waveform signal SWQ. For example, it is assumed that "DL=0 and DP=0" corresponds to black display and "DL=1 and DP=1" corresponds to white display. If so, when DL=0 and DP=0, the signal SWV (1, 1) is selected. When DL=0 and DP=1, the signal SWV (1, 2) is selected. When DL=1 and DP=0, the signal SWV (2, 1) is selected. When DL=1 and DP=1, the signal SWV (2, 2) is selected.

The display data storage section 20 includes the present display data storage section 22 which stores the present display data DP and a previous display data storage section 24 which stores the previous display data DL. The present display data storage section 22 has, for example, a function similar to that of the shift register 580 in FIG. 2C, and the previous display data storage section 24 has a function similar to that of the latch circuit 570 in FIG. 2C.

For example, display data from a host is input to and held in the present display data storage section 22 via the host I/F 50. For example, when the number of segment electrodes is 124, display data (segment data) corresponding to 124 segment electrodes is input to and held in the present display data storage section 22. Then, when all the 124 pieces of display data are input to the present display data storage section 22 and the display based on the display data is ended, the display data held in the present display data storage section 22 is transmitted to and held (latched) in the previous display data storage section 24. The display data storage section 20 may be realized by a flip-flop, or a memory such as an SRAM.

The drive waveform information output section 30 includes a drive waveform generating section 32, a timing control section 34, and a loop control section 39. The drive waveform generating section 32 includes registers RT1 to RTM (M is an integer of 2 or more) corresponding to the first storage section 30A in FIG. 1 and a register selecting circuit RSEL corresponding to the output section 30C in FIG. 1. The timing control section 34 includes a timing set counter 36 and a wait timer 38. The loop control section 39 incorporates therein the second storage section 30B in FIG. 1. The loop control section 39 will be described later in detail with reference to FIG. 9 and the like.

The registers RT1 to RTM store register values for specifying the signal levels of the drive waveform signals SWV (1, 1) to SWV (2, 2) (SWV (1, 1) to SWV (N, N)) in the respective periods T1 to TM. Specifically, the register RTk ($1 \leq k \leq M$) of the registers RT1 to RTM stores the register value for specifying the signal levels of the drive waveform signals SWV (1, 1) to SWV (2, 2) in the period Tk of the basic periods T1 to TM. For example, the register RT1 stores the register value for specifying the signal levels of the signals SWV (1, 1) to SWV (2, 2) in the period T1, and the register RT2 stores the register value for specifying the signal levels of the signals SWV (1, 1) to SWV (2, 2) in the period T2. The same applies to the registers RT3 to RTM. The register values of the registers RT1 to RTM are input via the host I/F 50 and written in the registers RT1 to RTM.

The register selecting circuit RSEL selects, based on a selection signal SRSEL from the timing control section 34, the register value of any of the registers RT1 to RTM. For example, the register value of the register RT1 is selected in the period T1, and the register value of the register RT2 is selected in the period T2. The same applies to the periods T3 to TM. Thus, the drive waveform information output section 30 can output the register values of the registers RT1 to RTM in the respective periods T1 to TM. Specifically, the drive waveform information output section 30 outputs the register value of the register RTk of the registers RT1 to RTM in the period Tk. For example, the drive waveform information output section 30 outputs the signal level register value of the register RT1 in the period T1 and outputs the signal level register value of the register RT2 in the period T2. The same applies to the periods T3 to TM.

The registers RT1 to RTM can store, for example, period length register values for specifying the lengths of the respective periods T1 to TM, in addition to the signal level register values of the drive waveform signals SWV (1, 1) to SWV (2, 2). For example, the register RTk of the registers RT1 to RTM stores a period length register value for setting the length of the period Tk. The signal level register value and the period length register value can be referred to as drive waveform information. However, the period length register value is not essential. If the length of each of the periods T1 to TM is constant, the period length register value is not necessary.

Then, the drive waveform information output section 30 sets the length of the period Tk based on the period length register value of the register RTk. For example, the drive waveform information output section 30 sets the length of the period T1 based on the period length register value of the register RT1 and sets the length of the period T2 based on the period length register value of the register RT2. The same applies to the settings of lengths of the periods T3 to TM.

Specifically, the period length register values of the registers RT1 to RTM are input, as a signal SWT, to the timing control section 34 via the register selecting circuit RSEL. Then, a wait timer value is set in the wait timer 38 based on the signal SWT. The timing set counter 36 outputs the signal SRSEL obtained based on the wait timer value to the drive waveform generating section 32. Thus, the lengths of the periods T1 to TM are controlled.

Moreover, the registers RT1 to RTM may also store register values for setting the output terminal of the drive circuit DR to be in the high impedance state. For example, in the case of setting the output terminal of the drive circuit DR to be in the high impedance state in the period Tk, a setting bit (bit 13 in FIG. 6A, which will be described later) for the high impedance state of the register RTk corresponding to the period Tk is set to "1", for example. Thus, the setting signal SHZ for the high impedance state becomes active in the period Tk.

The host I/F 50 performs an interface process with respect to the host (CPU, MPU, control device). The host accesses control registers such as a display setting register 52, a trigger register 54, an interrupt register 56, and a power setting register 58 via the host I/F 50.

For example, the display setting register 52 is a register for setting an instruction to select clocks used by various timers of the timing control section 34, an instruction to invert the display from the display state of the electro-optical panel, an instruction to perform all black display or all white display, an instruction to select the direct mode or the sequential mode, and the like. The trigger register 54 is a register for issuing a trigger for starting a drive waveform generating operation. The interrupt register 56 is a register in which an interrupt flag or an interrupt mask generated after the completion of the drive waveform generating operation is set. The power setting register 58 is a register for performing various controls such as an on-off instruction of the power supply circuit 70, setting of a constant voltage circuit (regulator), setting of a boosting multiple, and fine adjustment (contrast, trimming) of a boosting voltage.

The power supply circuit 70 generates, based on the power supply voltage supplied from a power supply terminal, a drive power supply voltage necessary for driving the electro-optical panel. For example, in the case of binary driving of 0 V and 15 V, the power supply circuit 70 boosts a power supply voltage from a VDD terminal to generate, for example, a drive power supply voltage of HVDD=15 V, and supplies the drive power supply voltage to the drive circuit DR of the drive voltage output section 10. The drive circuit DR uses HVDD=15 V and VSS=0 V from a VSS terminal to output the drive voltage VDm.

A drive power supply voltage may be supplied from an external power supply IC or the like of the integrated circuit device to an HVDD terminal. For example, when a load current higher than that defined in the specification of the power supply circuit 70 to be incorporated is required at the time of driving because the size of the electro-optical panel is large, the drive power supply voltage HVDD may be supplied from the external power supply IC or the like as described above.

The clock generating circuit 82 includes an oscillator circuit 84 and a division circuit 86, and generates clocks CK at various frequencies. The clock selecting circuit 80 supplies the timing control section 34 and the like with a clock CKS selected from the clocks CK of the clock generating circuit 82.

When the integrated circuit device includes a plurality of I/O cells (input/output cells), it is desirable to dispose the drive voltage output section 10 in FIG. 3 for each of the plurality of I/O cells. Here, the I/O cell is an input/output cell connected to the pad (terminal) of the integrated circuit device and having at least one of an input buffer and an output buffer.

Figure 4:
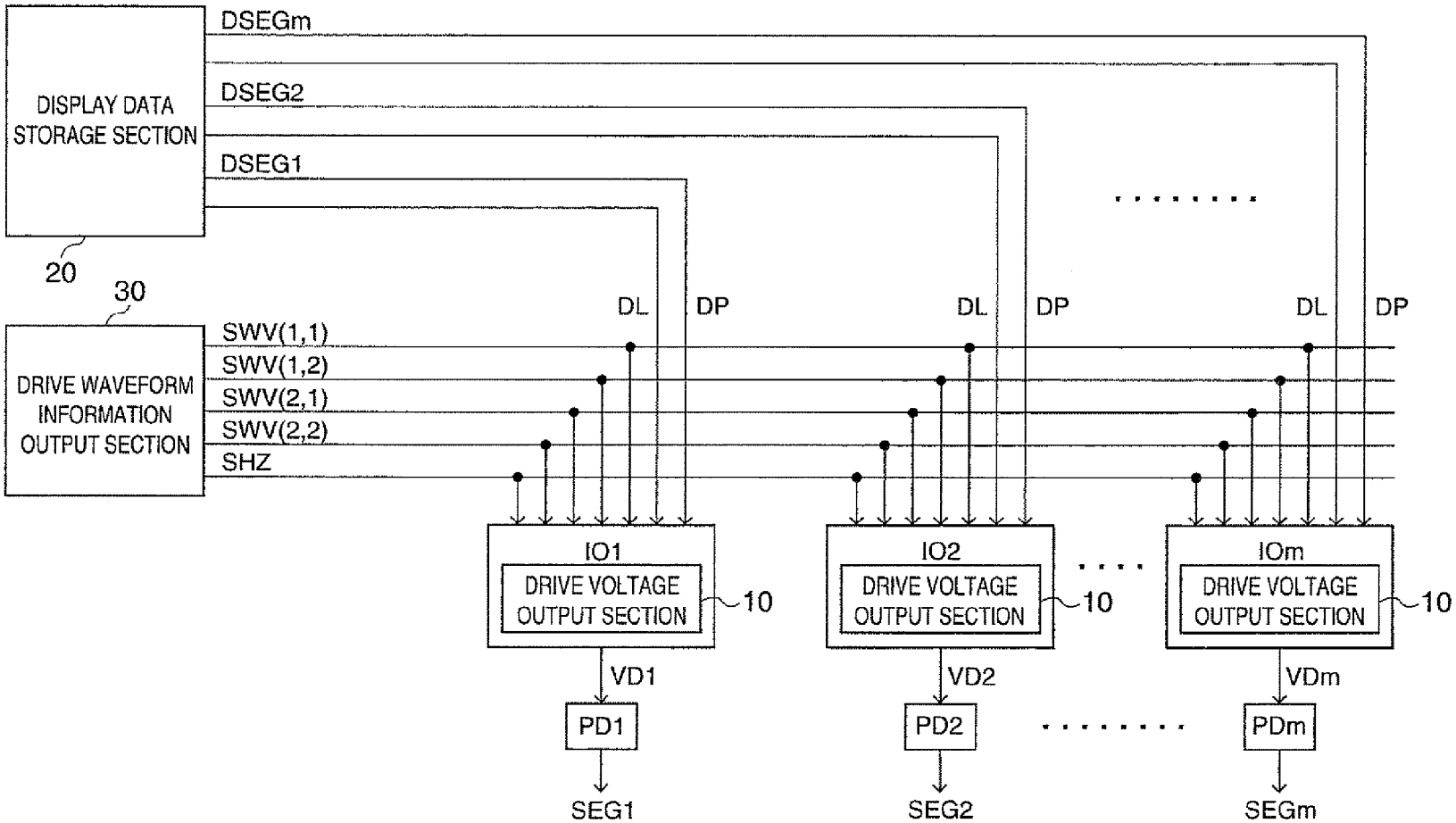
FIG. 4 is an explanatory view of a method for disposing a drive voltage output section in each I/O cell.

For example, in FIG. 4, the drive voltage output section 10 is disposed for each of I/O cells IO1 to IOm. The drive voltages VD1 to VDm output from the drive voltage output sections 10 of the I/O cells IO1 to IOm are output to segment electrodes SEG1 to SEGm of the electro-optical panel via pads PD1 to PDm.

The drive waveform signals SWV (1, 1) to SWV (2, 2), the high impedance setting signal SHZ, and the like from the drive waveform information output section 30 are supplied to the I/O cells IO1 to IOm. Signal lines of the signals SWV (1, 1) to SWV (2, 2) and SHZ are routed on an area (area opposite to the pads) on chip core sides of the I/O cells or on the I/O cells, and the signals SWV (1, 1) to SWV (2, 2) and SHZ are supplied from the signal lines to each of the I/O cells. Moreover, the respective pieces of display data (DL, DP) of DSEG1 to DSEGm from the display data storage section 20 are supplied to the I/O cells IO1 to IOm.

As shown in FIG. 4, when the hard macro I/O cell provided with the drive voltage output section 10 is disposed, layout efficiency can be improved and the chip size of the integrated circuit device can be reduced. The logic circuit of the drive voltage output section 10 may be formed in a logic circuit block composed of a gate array or a standard cell through automatic placement and routing, or the like, together with other logic circuits.

3. Drive Waveform

Next, a specific example of a method for generating drive waveforms in the basic periods T1 to TM will be described with reference to FIGS. 5 to 8B. In FIGS. 5 to 8B, it is assumed that a drive waveform in a period specified by the first designated period and the number of times of the repetition of the first designated period is not designated.

For example, in the EPD, white display or black display is performed according to the polarity of a drive bias applied between the segment electrode (data electrode) and the top plane electrode (common electrode). By inserting a color filter, a color can also be produced during the white display. In this case, the white of the white display can be replaced with the color of the filter.

For maintaining high display quality of the EPD, it is not sufficient to apply a bias of a drive polarity necessary for simple white display or black display. For example, when changing the display of the BPD, it is desirable not only to apply a necessary bias to a segment to be subject to display change such as the change from white to black or from black to white, but also to apply a sequential drive bias including both a positive polarity bias and a negative polarity bias to all segments including a segment not to be subject to the display change such as, for example, the change from black to black or from white to white. When the display quality is not significant, this is not restrictive.

Then, a sequential drive bias pattern including both the positive polarity bias and the negative polarity bias is set corresponding to the changes in display state, such as from black to white, from white to black, from black to black, and from white to white. In the embodiment, such a pattern is referred to as a drive waveform.

Figure 5:
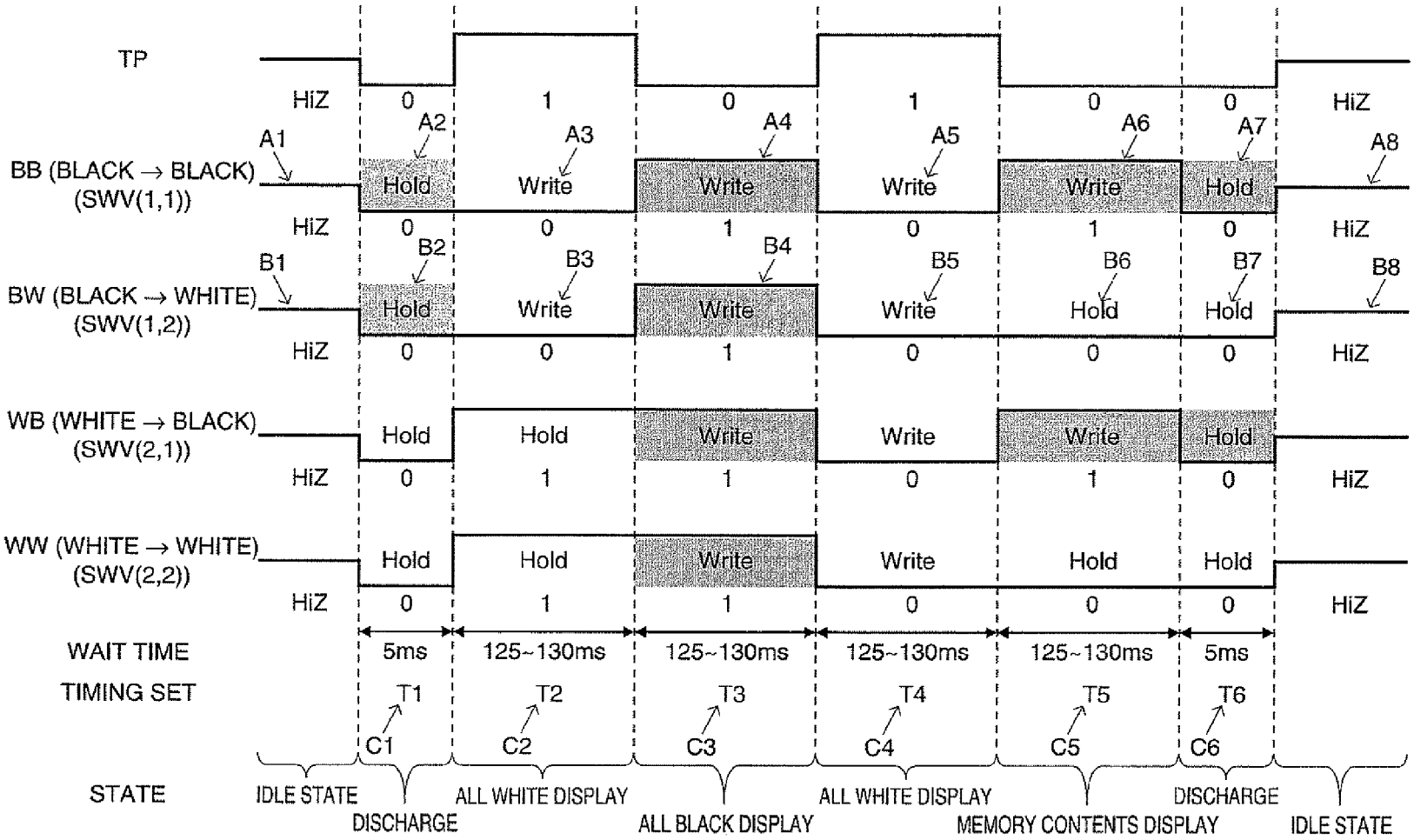
FIG. 5 shows drive waveform examples for explaining the operation of the embodiment.

FIG. 5 shows examples of such drive waveforms. In FIG. 5, "0" represents 0 V-driving, for example, and "1" represents 15 V-driving, for example.

In FIG. 5, TP is a drive waveform of two values to be supplied to the top plane electrode common in all the segments. BB is a drive waveform in changing of the display state from black to black; BW from black to white; WB from white to black; and WW from white to white (when the display state changes from the first display state to the second display state). The drive waveforms BB, BW, WB, and WW correspond to the drive waveform signals SWV (1, 1), SWV (1, 2), SWV (2, 1), and SWV (2, 2), respectively, in FIG. 3.

For example, in an idle state of A1 in FIG. 5, the high impedance state is set. In a discharge period of A2, no bias is applied because TP=0 and BB=0, and the black display is maintained. In A3, a positive polarity bias is applied because TP=1 and BB=0, and the display changes from the black display to the white display. In A4, a negative polarity bias is applied because TP=0 and BB=1, and the display changes from the white display to the black display. In A5, a positive polarity bias is applied because TP=1 and BB=0, and the display changes from the black display to the white display.

In A6, TP=0 and BB=1, the contents of the memory are displayed, and the black display is performed. That is, since BB is a drive waveform in the case where the first display state is the black display and the second display state is the black display, the black display corresponding to the second display state (display data DP) is performed in A6. Thereafter, the discharge indicated by A7 is performed, and the idle state indicated by A8 is reached.

Similarly, in the drive waveform BW as indicated by B1, B2, B3, B4, and B5, the idle state, the discharge, the white display, the black display, and the white display are performed. In B6, no bias is applied because TP=0 and BW=0, and the white display set in B5 is maintained, so that the contents of the memory are displayed. That is, since BW is a drive waveform in the case where the first display state is the black display and the second display state is the white display, the white display corresponding to the second display state (display data DP) is performed in B6. Thereafter, the discharge indicated by B7 is performed, and the idle state indicated by B8 is reached. The same applies to the drive waveforms WB and WW.

In C1, C2, C3, C4, C5, and C6, the lengths of the respective periods T1, T2, T3, T4, T5, and T6 are set. That is, temporal timings for changing the drive waveforms are set.

As shown in FIG. 5, before displaying the actual contents (waveform information) of the memory, the white display and the black display are repeatedly performed in the periods set with various lengths, so that high display quality of the EPD can be realized. That is, in the EPD different from the LCD, when the display state changes from the first display state corresponding to the previous display data (DL) to the second display state corresponding to the present display data, a drive waveform is sequentially changed over a plurality of periods. For example, in A2 to A6 in FIG. 5, when the display state changes from the black display as the first display state to the black display as the second display state, the drive waveform is changed in each of the plurality of periods. Similarly, in B2 to B6, when the display state changes from the black display as the first display state to the white display as the second display state, the drive waveform is changed in each of the plurality of periods. The drive waveform is sequentially changed as described above, whereby display quality can be improved.

FIG. 6A shows an example of register values set in the registers RT1 to RTM in FIG. 3 for realizing the drive waveforms in FIG. 5. T1 to T12 in FIG. 6A correspond to the registers RT1 to RT12, respectively, and a 16-bit wide register value is set in each register. Pieces of information of the drive waveforms TP, BB, BW, WB, and WW are respectively stored in bits 12, 11, 10, 9, and 8 of each register. In bits 7 to 0, length information (the number of counts used by the wait timer of the timing control section) of each period is set.

Bit 15 of each register is an EOW bit, which represents the end of the drive waveform. In FIG. 6A, the EOW bit of the register RT6 corresponding to the period T6 is set to 1. Accordingly, in FIG. 5, the drive waveforms end at the period T6.

The bits 12 to 8 of the register RT1 corresponding to the period T1 in FIG. 6A are all set to 0. Accordingly, as shown in the drive waveforms in FIG. 5, since TP=BB=BW=WB=WW=0, the discharge is performed. Moreover, the bits 7 to 0 representing the wait time of the register RT1 are set to (00000101). Accordingly, as shown in FIG. 6B, the length of the period T1 is set to about 4.88 mS.

The bits 12, 11, 10, 9, and 8 of the register RT2 corresponding to the period T2 in FIG. 6A are set to 1, 0, 0, 1, and 1, respectively. Accordingly, as shown in the drive waveforms in FIG. 5, since TP=1, BB=0, BW=0, WB=1, and WW=1 in the period T2, all white display is performed. Moreover, the bits 7 to 0 representing the wait time of the register RT2 are set to (10000011). Accordingly, as shown in FIG. 6B, the length of the period T2 is set to about 127.93 mS.

The lengths of the periods described above are only examples. The length can be changed to any values by the register value set in the register RTk and the clock selection by the clock selecting circuit 80.

Figure 7:
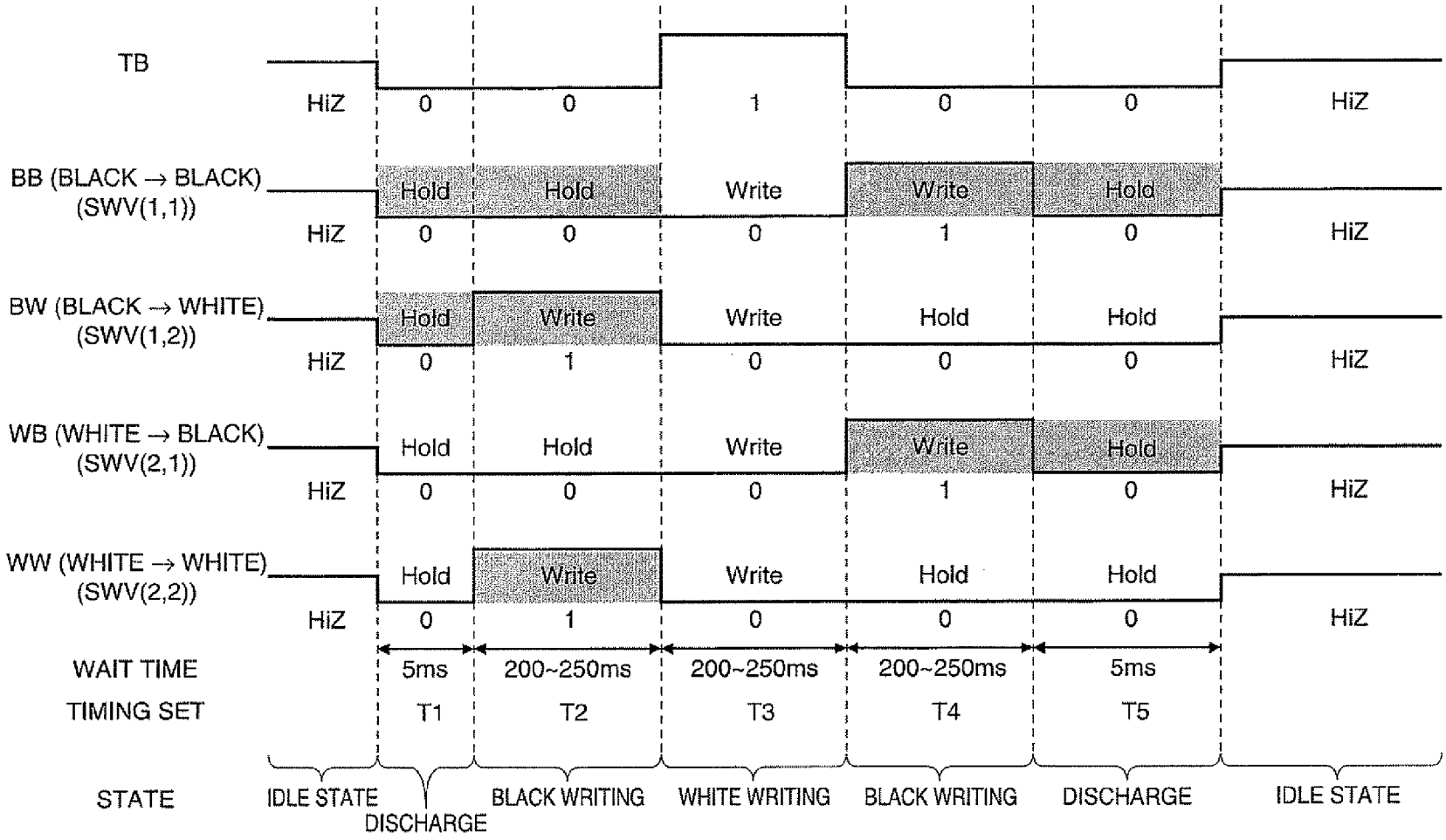
FIG. 7 shows drive waveform examples for explaining the operation of the embodiment.

The drive waveforms are not limited to those in FIG. 5. The drive waveforms can be appropriately changed by changing the register value of the register RTk according to the type, operation environments, and the like of the EPD. For example, FIG. 7 shows another example of drive waveforms, and FIGS. 8A and 8B show a setting example of register values corresponding to the drive waveforms in FIG. 7.

In the embodiment as described above, the output drive waveform signal SWQ is selected from the plurality of drive waveform signals SWV (1, 1) to SWV (2, 2) based on the first and second display data DL and DP, and the drive voltage VDm specified by the selected output drive waveform signal SWQ is output. Accordingly, when the display state changes from the first display state corresponding to the first display data DL to the second display state corresponding to the second display data DP, the segment electrode of the electro-optical panel can be driven by, for example, the drive voltage of a sequentially changing drive waveform signal. Accordingly, display characteristics with high quality can be realized. Moreover, in the embodiment, since the sequential drive waveform signal is automatically generated, the processing load of the host (control device) can be reduced.

Moreover, in the embodiment, the registers RT1 to RTM store register values for specifying the signal levels of the drive waveform signals in the respective periods. Then, the register values from the respective registers are output in the respective periods. Accordingly, the signal levels of the drive waveform signals in the respective periods can be set by the register values of the respective registers to change the drive waveform signals. Accordingly, drive waveform signals of various waveforms can be generated according to display characteristics of the electro-optical panel.

Moreover, in the embodiment, the lengths of the respective periods can be set based on the period length register values stored in the respective registers. Accordingly, since not only the signal levels in the respective periods but also the lengths of the respective periods of the drive waveform signals can be variably set, further various drive waveform signals can be generated.

4. Drive Waveform Information Output Section

Figure 9:
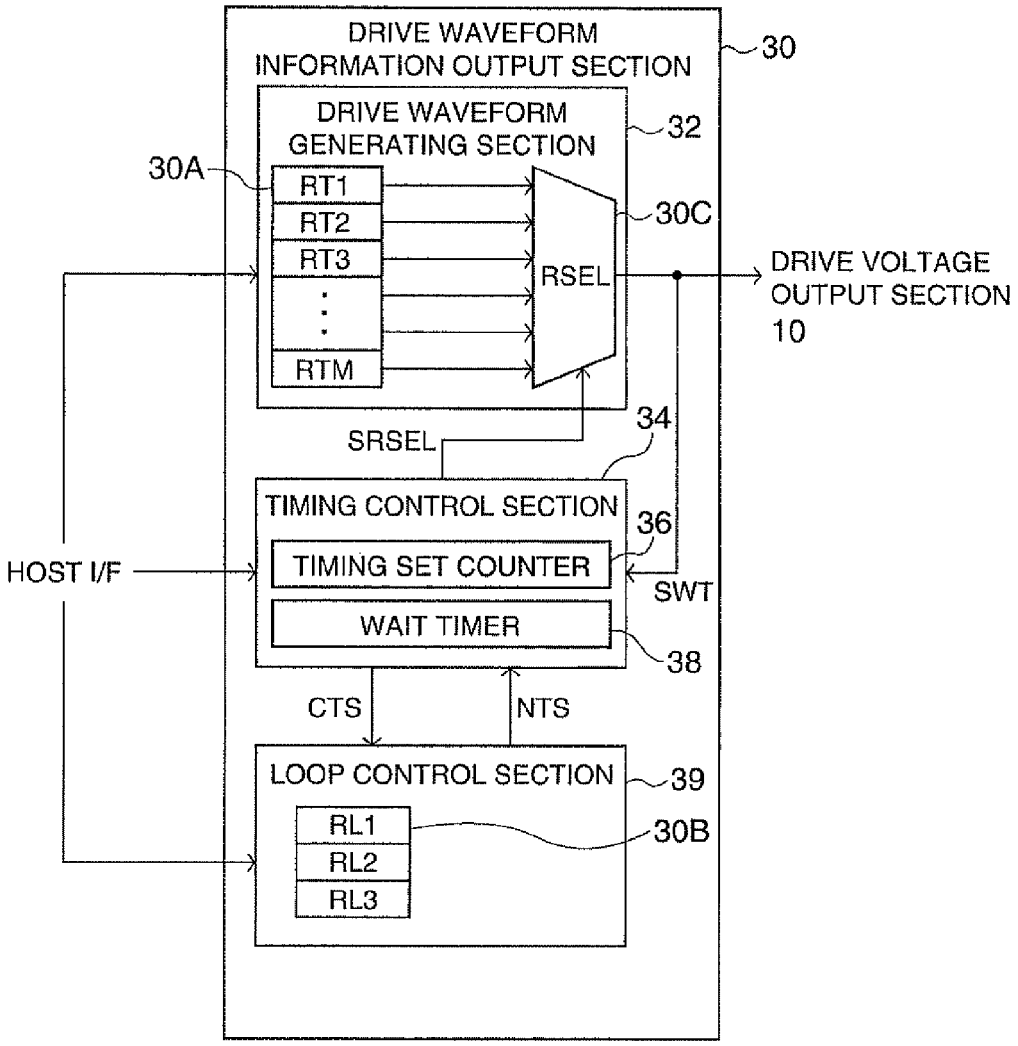
FIG. 9 shows a configuration example of a drive waveform information output section.

FIG. 9 shows a more specific configuration example of the drive waveform information output section 30 shown in FIGS. 1 and 3. As shown in FIG. 9, the drive waveform information output section 30 has first to third registers RL1 to RL3 (the second storage section 30B) in addition to the registers RT1 to RTM (the first storage section) as the first storage section 30A.

Figure 10:
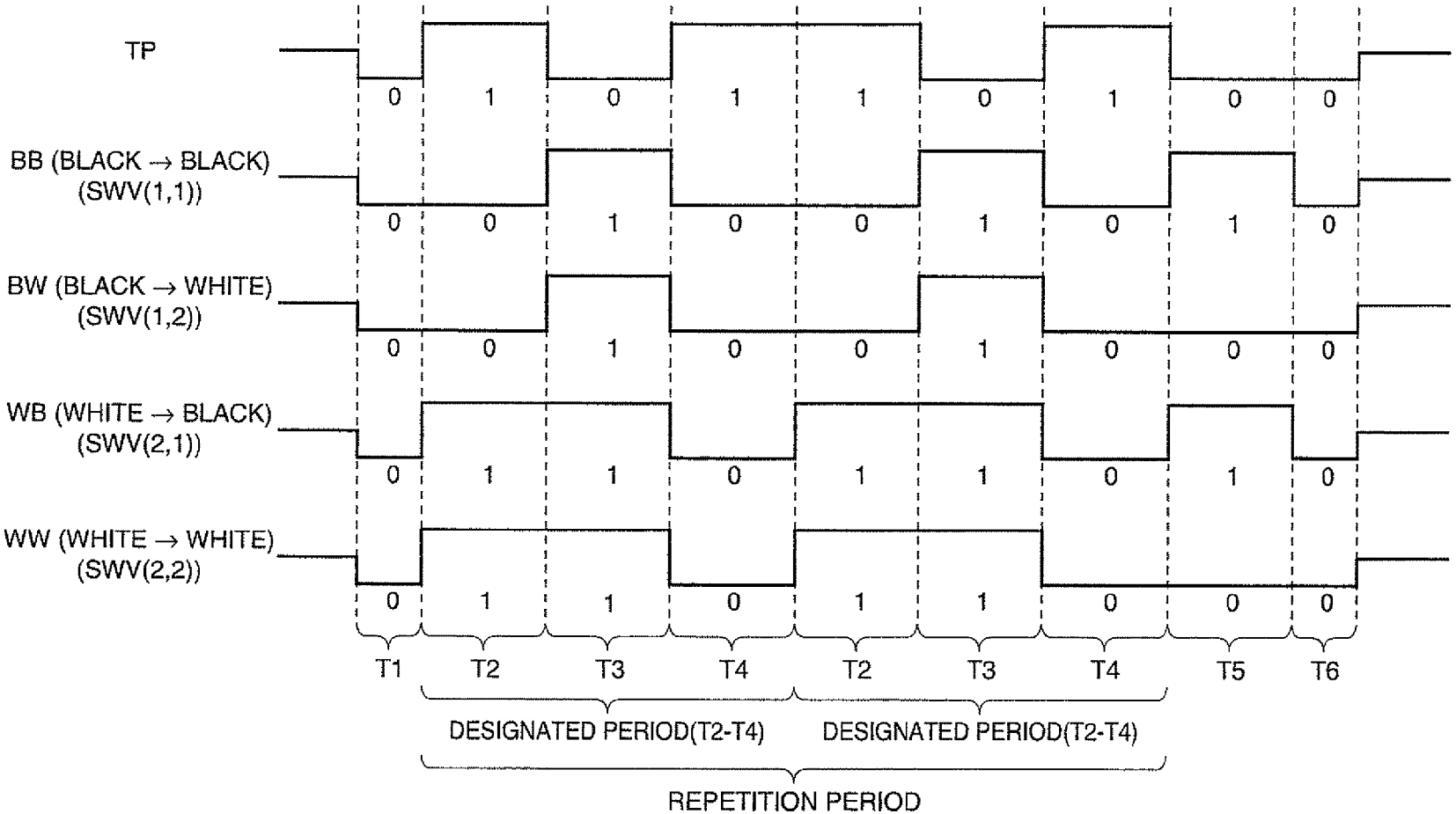
FIG. 10 shows a modified example of the drive waveforms in FIG. 5.

Different from the drive waveforms in FIG. 5, FIG. 10 shows drive waveforms each of which is output sequentially by repeating, based on the first designated period where at least one of the basic periods T1 to TM is designated and the number of times of repetition (the first number of times of repetition) of the first designated period, the drive waveform information IDWV within the first designated period the number of times designated. since the drive waveform information output section 30 in FIG. 9 has the loop control section 39 which uses the first to third registers RL1 to RL3, the periods T2 to T4, for example, of the periods T1 to T6 in FIG. 5, for example, can be repeated twice, for example (refer to FIG. 10).

The first register RL1 in FIG. 9 can store (designate) one (for example, the period T2 in FIG. 10) of the periods T1 to TM corresponding to the registers RT1 to RTM as a starting period of the designated period. The second register RL2 can store (designate) one (for example, the period T4 in FIG. 10) of the periods T1 to TM as an ending period of the designated period. Further, the third register RL3 can store (designate) the number of times of repetition (for example, twice in FIG. 10) of the designated period (from the starting period to the ending period).

The timing control section 34 in FIG. 9 can send a present period CTS selected by the register selecting circuit RSEL to the loop control section 39. The loop control section 39 can determine, based on the present period CTS, the starting period, the ending period, and the number of times of repetition, a next period NTS to send the next period to the timing control section 34.

The register selecting circuit RSEL, which outputs the register value from the register RTk of the registers RT1 to RTM to the drive voltage output section 10 in the period Tk, can be referred to as the output section 30C in FIG. 1. The register selecting circuit RSEL (the output section 30C of the drive waveform information output section 30) can output drive waveform information (for example, the drive waveform signals SWV (1, 1) to SWV (2, 2) in FIG. 10) in each period specified by the periods T1 to TM, the designated period (the starting period and the ending period in a more limited sense), and the number of times of repetition.

In the example of FIG. 10, in a repetition period specified by the starting period (the period T2), the ending period (the period T4), and the number of times of repetition (twice), the drive waveform information output from the output section 30C (the register selecting circuit RSEL) of the drive waveform information output section 30 in the designated period from the starting period to the ending period is repeated the number of times of repetition.

The host can access the registers RL1 to RL3 (the second storage section 308) via the host I/F 50. In the designated period, at least one (basic period) of the periods T1 to TM can be set. Drive waveform information is generated by repeating the basic period, so that the number of the registers RT1 to RTM can be reduced to reduce the entire storage capacity of the registers RT1 to RTM. Moreover, according to the combination of the designated period and the number of times of repetition, drive waveform information (the drive waveform signals SWV (1, 1) to SWV (N, N) in a more limited sense) can be set to be adapted to a plurality of electro-optical panels.

When the number of the registers RT1 to RTM is not changed, the repetition of the basic period can generate more types of drive waveform information.

FIGS. 11A and 11E3 each show a modified example of the first to third registers RL1 to RL3 in FIG. 9. As shown in FIG. 11A, first and second registers each having, for example, a 16-bit wide register value set therein are prepared. The starting and ending periods of the designated period can be respectively designated by, for example, a bit string 12-8 and a bit string 4-0 of the first register specified by address 0x5608, and the number of times of repetition of the designated period can be designated by, for example, a bit string 7-0 of the second register specified by address 0x560a.

As shown in FIG. 11B, four registers each having, for example, a 16-bit wide register value set therein may be prepared. The starting and ending periods of the first designated period can be respectively designated by, for example, a bit string 12-8 and a bit string 4-0 of a first register specified by, for example, address 0x5608. The first number of times of repetition of the first designated period can be designated by, for example, a bit string 7-0 of a second register specified by, for example, address 0x560a. The starting and ending periods of a second designated period can be respectively designated by, for example, a bit string 12-8 and a bit string 4-0 of a third register specified by, for example, address 0x560c. A second number of times of repetition of the second designated period can be designated by, for example, a bit string 7-0 of a fourth register specified by, for example, address 0x560e. In this manner, the second storage section 305 can store a plurality of designated periods and a plurality of numbers of times of repetition. The second storage section 30B or the registers RL1 to RL3 in FIG. 9 are not limited to the examples of FIG. 11A and FIG. 11B, and various modifications can be made.

Figure 12:
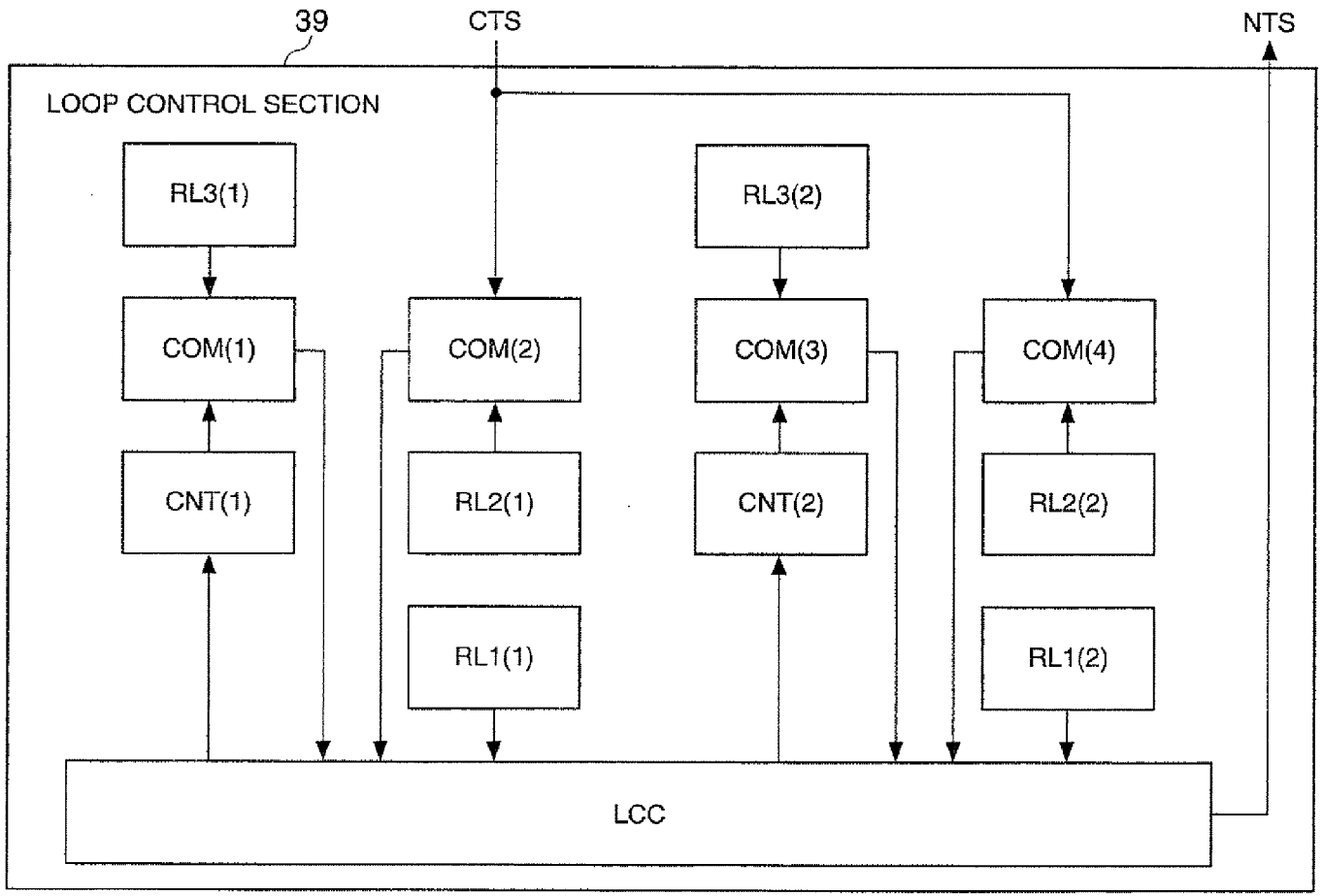
FIG. 12 shows a configuration example of a loop control section in FIG. 9.

FIG. 12 shows a configuration example of the loop control section 39 in FIG. 9. In the example of FIG. 12, the loop control section 39 in FIG. 9 can repeat, for example, two designated periods and has registers RL1(1), RL1(2), RL2(1), RL2(2), RL3(1), and RL3(2) as the second storage section 305.

Figure 13:
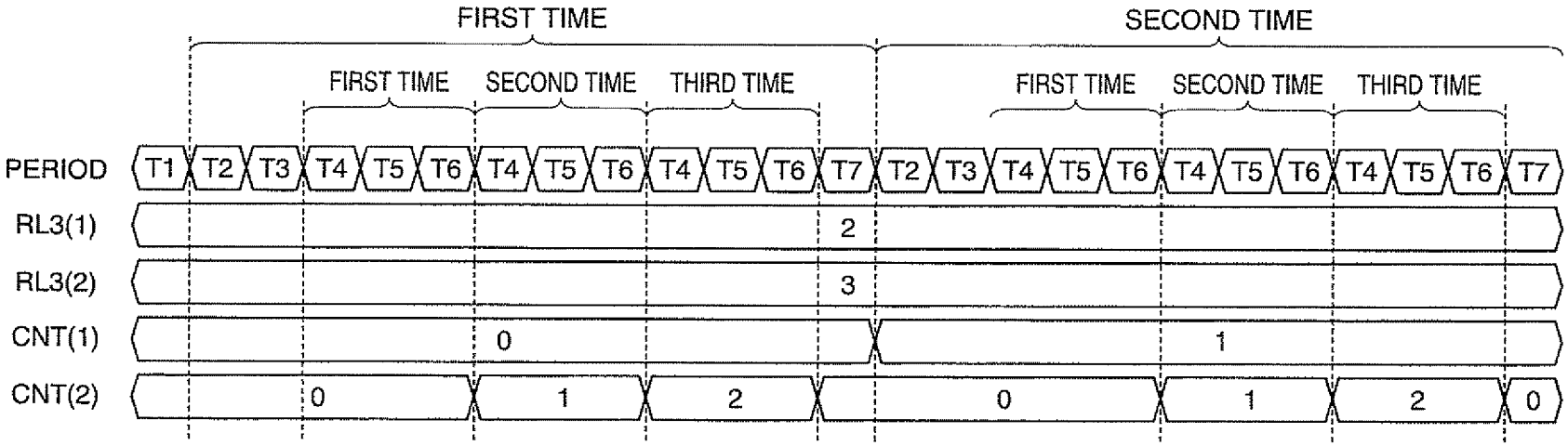
FIG. 13 shows a setting example of a first designated period and a second designated period.

FIG. 13 shows a setting example of the first designated period and the second designated period. FIG. 13 shows an example in which the second designated period (the periods T4 to T6) is set within the first designated period (the periods T2 to T7). In the case of repeating, for example, two designated periods, as shown in FIG. 13, it can be set such that every time the first designated period (the periods T2 to T7) is repeated, also the second designated period (the periods T4 to T6) is repeated.

Since the periods T1 to T7 are selected one after another in the order shown in FIG. 13, for example, the register RL1(1) in FIG. 12 stores the period T2 as the starting period of the first designated period. The register RL2(1) in FIG. 12 can store, for example, the period T7 as the ending period of the first designated period. Further, the register RL3(1) in FIG. 12 can store, for example, "2" as the number of times of repetition of the first designated period.

The register RL1(2) in FIG. 12 can store, for example, the period T4 as the starting period of the second designated period. The register RL2(2) in FIG. 12 can store, for example, the period T6 as the ending period of the second designated period. Further, the register RL3(2) in FIG. 12 can store, for example, "3" as the number of times of repetition of the second designated period.

In the example of FIG. 12, the loop control section 39 has a counter CNT(1) which counts repetitions of the first designated period. The loop control section 39 has a counter CNT (2) which counts repetitions of the second designated period. Moreover, the loop control section 39 can have a comparator COM(1) which compares the register value of the register RL3(1) with the counter value of the counter CNT(1). Further, the loop control section 39 can have a control section LCC which manages the repetition of the first designated period. The loop control section 39 can further have comparators COM(2), COM(3), and COM(4).

Hereinafter, an operation example of the loop control section 39 in FIG. 12 for selecting, one after another, the periods T1 to T7 shown in FIG. 13 will be described. The loop control section 39 in FIG. 12 resets the counter values of the counters CNT(1) and CNT(2) to, for example, "0" in an initial operation (refer to FIG. 13).

The comparator COM(1) in FIG. 12 can compare the counter value (for example, "0" in the initial operation) of the counter CNT(1) with the register value (for example, "2" as the number of times of repetition of the first designated period) stored in the register RL3(1). The comparator COM (1) can send the comparison result to the control section LCC. The counter CNT(1) counts up one by one at each timing of loop end after implementing the first designated period (the periods T2 to T7) (refer to FIG. 13). Then, as shown in FIG. 13, the count value (for example, "1") at the timing of loop completion at which the first designated period (the periods T2 to T7) completes the designated number of times of repetition (twice) is equal to the value (for example, "2−1=1") obtained by subtracting 1 from the register value stored in the register RL3(1). In that case, the control section LCC can recognize that for example, the repetition of the first designated period is the last one (for example, refer to the periods T2 to T7 (the second repetition of the first designated period) in FIG. 13). At that time, the counter CNT(1) is reset to 0.

The comparator COM(2) in FIG. 12 can compare the counter value (for example, "0" in the initial operation) of the counter CNT(2) with the register value (for example, "3" as the number of times of repetition of the second designated period) stored in the register RL3(2). The comparator COM (2) can send the comparison result to the control section LCC. The counter CNT(2) counts up one by one at each timing of loop end after implementing the second designated period (the periods T4 to T6) (refer to FIG. 13). Then, as shown in FIG. 13, the count value (for example, "2") at the timing of loop completion at which the second designated period (the periods T4 to T6) completes the designated number of times of repetition (3 times) is equal to the value (for example, "3−1=2") obtained by subtracting 1 from the register value stored in the register RL3(2). Thus, the control section LCC can recognize that, for example, the repetition of the second designated period is the last one (for example, refer to the periods T4 to T6 (the third repetition of the second designated period) in FIG. 13). At that time, the counter CNT(2) is reset to 0 (refer to FIG. 13).

The loop control section 39 in FIG. 12 can receive, for example, the period T1 as the present period CTS with the comparator COM(2) from the timing control section 34 in FIG. 9. The comparator COM(2) can compare the present period CTS (for example, the period T1) with the period (for example, the period T7) stored in the register RL2(1). The comparator COM(2) can send, as the comparison result, the fact whether or not the present period CTS (for example, the period T1) coincides with the period (for example, the period T7) stored in the register RL2(1) to the control section LCC.

The loop control section 39 in FIG. 12 can receive, for example, the period T1 as the present period CTS with the comparator COM(4) from the timing control section 34 in FIG. 9. The comparator COM(4) can compare the present period CTS (for example, the period T1) with the period (for example, the period T6) stored in the register RL2(2). The comparator COM(4) can send, as the comparison result, the fact whether or not the present period CTS (for example, the period T1) coincides with the period (for example, the period T6) stored in the register RL2(2) to the control section LCC.

If the present period CTS coincides with the period stored in the register RL2(2), the control section LCC uses, as the next period NTS, the period (for example, the period T4) stored in the register RL1(2) for repeating the second designated period (the periods T4 to T6) (for example, refer to the switching from the period T6 to the period T4 in ending of the first repetition of the second designated period in FIG. 13).

If the repetition of the second designated period is the last one and the present period CTS coincides with the period stored in the register RL2(2), the control section LCC resets the repetition of the second designated period (the periods T4 to T6) and resets the counter value of the counter CNT(2) to, for example, "0" (for example, refer to the periods T4 to T6 (the period T7 at which the third repetition of the second designated period ends) in FIG. 13). At this time, the control section LCC executes a normal operation and uses, as the next period NTS, a period next to the present period CTS (for example, refer to the switching from the period T6 to the period T7 in ending of the third repetition of the second designated period in FIG. 13).

The control section LCC uses the comparison result of the comparator COM(2), similarly to the comparison result of the comparator COM(4), and determines the next period NTS while managing the repetition of the first designated period (the periods T2 to T7).

Figure 14:
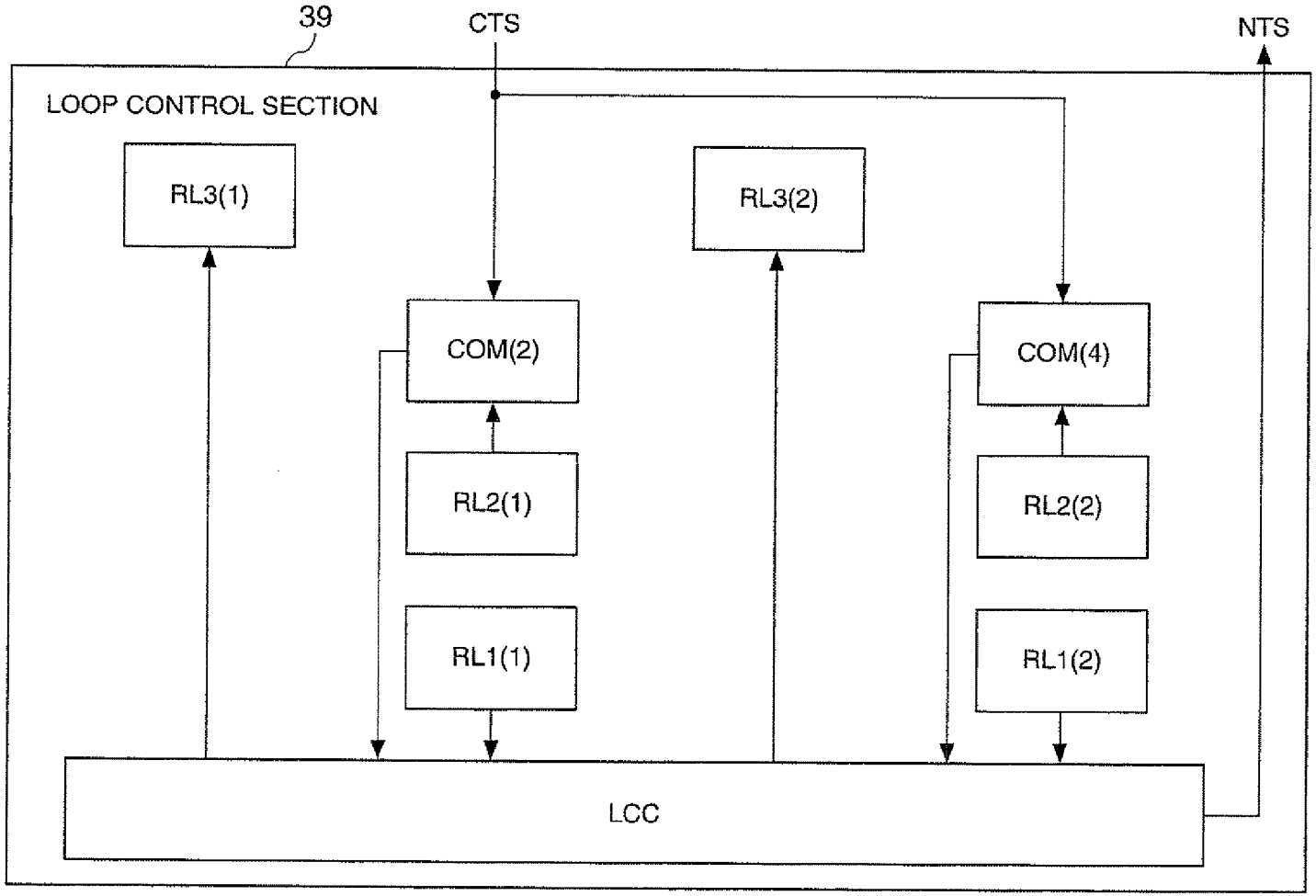
FIG. 14 shows a modified example of the loop control section in FIG. 12.

FIG. 14 shows a modified example of the loop control section 39 in FIG. 12. In the example of FIG. 14, the comparators COM(1) and COM(3) can be omitted, and the registers RL3(1) and RL3(2) can have the function of a counter. In the example of FIG. 12, the registers RL3(1) and RL3(2) continue to hold the number of times of repetition. In the example of FIG. 14, however, the number of times of repetition is rewritten in the registers RL3(1) and RL3(2).

Figure 15:
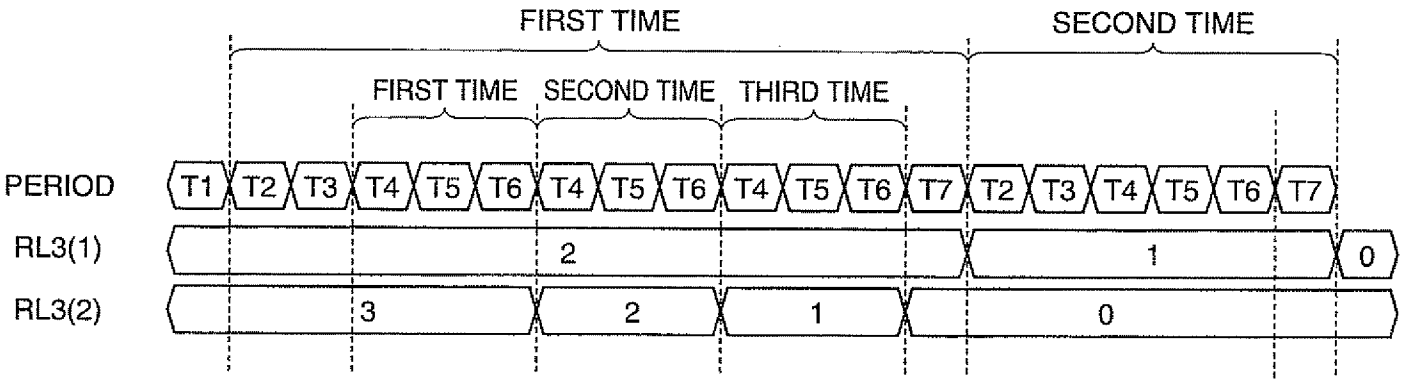
FIG. 15 shows another setting example of the first designated period and the second designated period.

FIG. 15 shows another setting example of the first designated period and the second designated period, which can be executed by, for example, the loop control section 39 in FIG. 14. The control section LCC in FIG. 14 rewrites the register value of the register RL3(2) every time the second designated period (for example, the periods T4 to T6) is repeated. Specifically, every time the second designated period (for example, the periods T4 to T6) is repeated, 1 is subtracted from the register value of the register RL3(2) until the register value is "0". When the register value of the register RL3(2) indicates "0", the repetition of the second designated period ends.

Moreover, the control section LCC in FIG. 14 rewrites the register value of the register RL3(1) every time the first designated period (for example, the periods T2 to T7) is repeated. Specifically, every time the first designated period (for example, the periods T2 to T7) is repeated, 1 is subtracted from the register value of the register RL3(1) until the register value is "0". When the register value of the register RL3(1) indicates "0", the repetition of the first designated period ends. As shown in FIG. 15, only within the initial first designated period, the second designated period is repeated the second number of times of repetition.

FIG. 16 shows a setting example of register values for generating drive waveforms and register values for loop control. As shown in FIG. 16, the registers RT1 to RTM in FIG. 9 has the functions of the first storage section 30A and the second storage section 30B. The register RTk ($1 \leq k \leq M$) of the registers RT1 to RT7 (RTM) shown in FIG. 16 has an area for storing the register value specifying signal levels, the starting and ending periods of the basic periods T1 to TM indicating the first designated period, and the first number of times of repetition. The 32-bit wide register RTk has an area for storing information of first to third bit strings. The first bit string 31-24 corresponds to the register value specifying the signal levels, the second bit string 15-8 corresponds to the first and second numbers of times of repetition, and the third bit string 4-0 corresponds to the starting periods of the first and second designated periods. For example, the registers RT6 and RT7 in which the first and second numbers of times of repetition and the starting periods are designated by the second and third bit strings designate the basic periods T6 and T7 corresponding to the registers RT6 and RT7 as the ending periods.

More specifically, as the number of times of repetition of the first designated period, "twice" can be stored with the second bit string 15-8 "00000010" of the register RT7 specified by address 0x18. As the number of times of repetition of the second designated period, "three times" can be stored with the second bit string 15-8 "00000011" of the register RT6 specified by address 0x14. The period (the period T7) corresponding to the register RT7 of the registers RT1 to RT7 each having one number of times of repetition stored therein can represent the ending period of the first designated period. The period (the period T6) corresponding to the register RT6 can represent the ending period of the second designated period.

In the example of FIG. 16, as the starting period of the first designated period, "the period T2" can be stored with the third bit string 4-0 "00010" of the register RT7 specified by the address 0x18. As the starting period of the second designated period, "the period T4" can be stored with the third bit string 4-0 "00100" of the register RT6 specified by the address 0x14.

Figure 17:
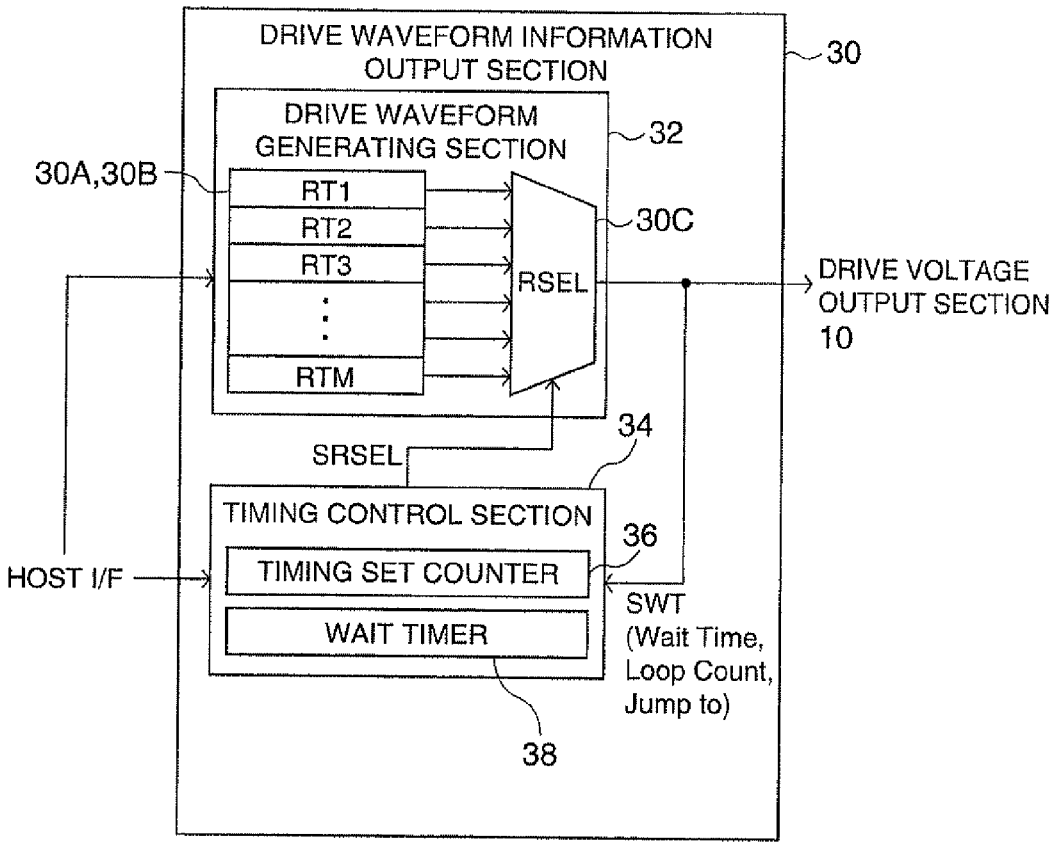
FIG. 17 shows a modified example of the drive waveform information output section in FIG. 9.

FIG. 17 shows a modified example of the drive waveform information output section 30 in FIG. 9, which corresponds to, for example, the expanded registers RT1 to RT7 in FIG. 16. As shown in FIG. 17, the drive waveform generating section 32 does not have the loop control section 39 shown in FIG. 9. Based on, for example, the signal SWT from the register selecting circuit RSEL shown in FIG. 17, the timing control section 34 can acquire the starting and ending periods and number of times of repetition of the designated period.

In the example of FIG. 17, the timing control section 34 can instruct the register selecting circuit RSEL to select any of the registers corresponding to the basic periods T1 to TM specified by the starting and ending periods and number of times of repetition of the designated period. In this manner, the drive waveform shown in FIG. 13 or 15 can be output by the drive waveform information output section 30 in FIG. 17. For obtaining the drive waveform shown in FIG. 15, the number of times of repetition represented by the second bit string 15-8 shown in FIG. 16 is subtracted as described above.

5. Modified Examples

Figure 18:
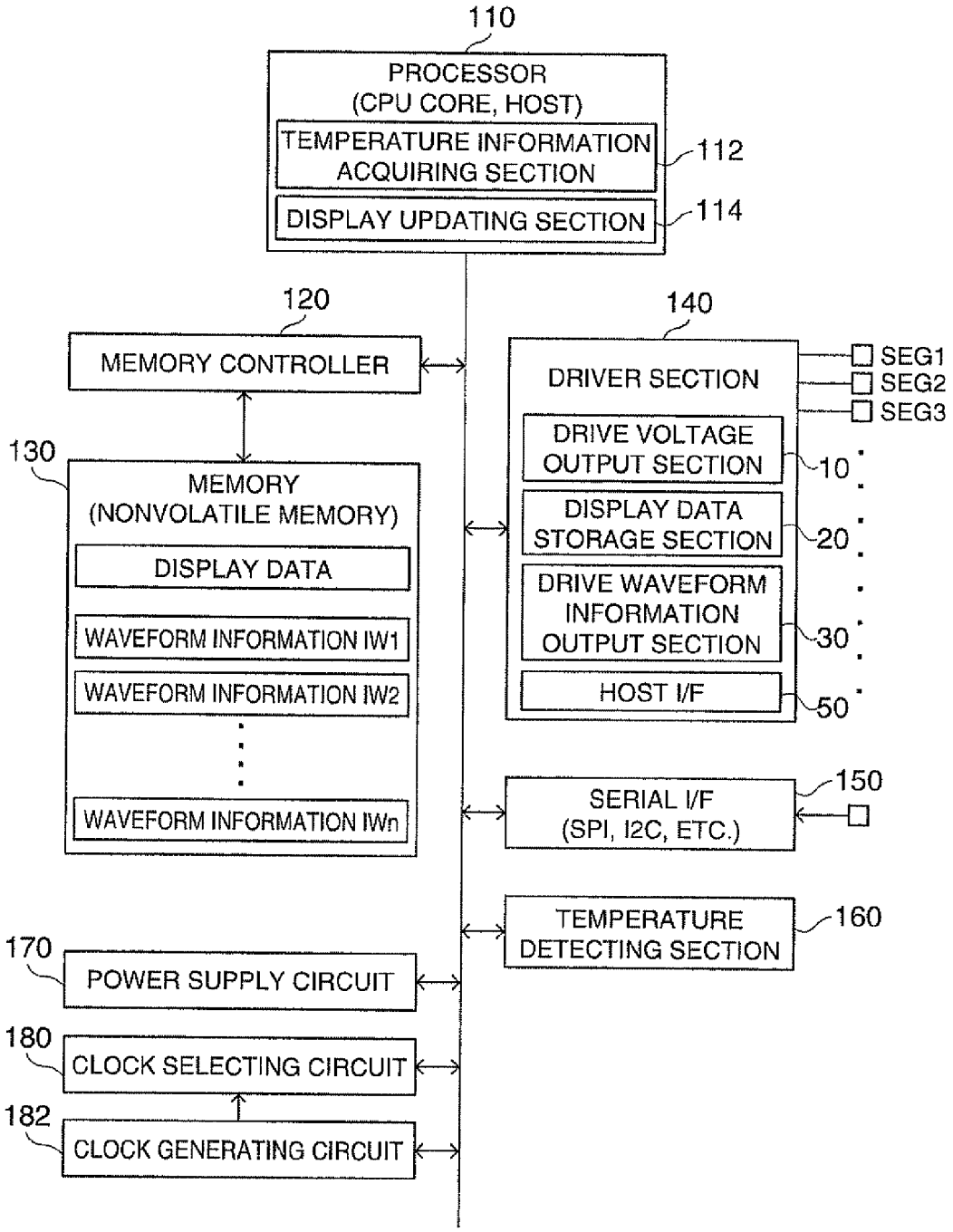
FIG. 18 shows a first modified example of the integrated circuit device of the embodiment.

Next, various modified examples of the embodiment will be described. FIG. 18 shows a first modified example of the integrated circuit device of the embodiment. The first modified example is an example applied to a microprocessor having a driver function. The integrated circuit device includes a processor 110, a memory controller 120, a memory 130, a driver section 140, a serial I/F 150, a temperature detecting section 160, a power supply circuit 170, a clock selecting circuit 180, and a clock generating circuit 182. Various modifications such as omission of a part of these constituent elements and addition of other constituent elements can be made.

The processor 110 (CPU core, host), which performs various control processes and operation processes, includes a temperature information acquiring section 112 and a display updating section 114. The temperature information acquiring section 112 acquires, for example, temperature information (environmental temperature) detected by the temperature detecting section 160. The display updating section 114 performs a process of changing the display of the electro-optical panel. The functions of the temperature information acquiring section 112 and the display updating section 114 can be realized by, for example, hardware of the processor 110 and firmware (software) executed by the processor 110. For example, the memory 130 stores firmware for executing the processes of the temperature information acquiring section 112 and the display updating section 114, and the processor 110 operates based on the firmware, so that the functions of the temperature information acquiring section 112 and the display updating section 114 are realized.

The memory controller 120 performs access control such as reading or writing control of the memory 130. The memory 130 is a nonvolatile memory such as a flash memory, for example. The memory 130 may also be a mask ROM or the like.

The driver section 140, which drives the electro-optical panel, includes the drive voltage output section 10, the display data storage section 20, the drive waveform information output section 30, and the host I/F 50.

The serial I/F 150 realizes a serial interface such as SPI or I2C with respect to the outside. The temperature detecting section 160 detects temperature using a temperature sensor or the like. For example, the temperature detecting section 160 measures information on the resistance ratio of a thermistor and a reference resistor to detect ambient temperature. The power supply circuit 170 generates and supplies various power supply voltages such as a drive power supply voltage. The clock generating circuit 182 generates clocks at various frequencies, and the clock selecting circuit 180 selects the clocks generated by the clock generating circuit 182.

In FIG. 18, the memory 130 stores a plurality of pieces of waveform information IW1 to IWn. When the memory 130 is a nonvolatile memory such as a flash memory, the waveform information IW1 to IWn is previously programmed in the nonvolatile memory. The processor 110 selects waveform information from the waveform information IW1 to IWn stored in the memory 130 via the memory controller 120. The selected waveform information, which is the waveform information selected, is transmitted to the driver section 140. The drive waveform information output section 30 of the driver section 140 outputs drive waveform information based on the selected waveform information. For example, the selected waveform information is set as register values (signal level and period length register values) of the registers RT1 to RTM in FIG. 3.

As described above, by storing the waveform information IW1 to IWn in the memory 130 which is accessible by the processor 110, necessary waveform information can be easily selected and transmitted when a drive waveform signal is generated using the waveform information.

The waveform information IW1 to IWn can be loaded from, for example, an external device (external memory etc.) using the serial I/F 150 or a general purpose input/output terminal to be written in the memory 130.

Moreover, when it is apparent that an integrated circuit device (custom IC etc.) does not require a plurality of pieces of waveform information, only predetermined waveform information may be stored in the memory 130.

In FIG. 18, the processor 110 as a host transmits the waveform information to the driver section 140, and then performs setting of the various registers 52, 54, 56, and 58 described in FIG. 3. For example, the processor 110 performs basic settings such as setting of a timer clock for determining timing time of a drive waveform, voltage and boosting settings of the power supply circuit 70, and enable/disable setting of an interrupt. Moreover, when an oscillator circuit necessary for generating the timer clock is different from an oscillator circuit serving as a clock source of the processor 110, setting for turning on the operation of the oscillator circuit is performed.

The various types of settings described above are realized by software (firmware) executed by an initialization routine of the processor 110. After performing the initialization, these settings may be unnecessary. After the initialization, it is possible to change the display of the electro-optical panel using a software process similar to that of a normal LCD driver or the like. Specifically, the processor 110 writes display data in the display data storage section 20 of the driver section 140. Then, the processor 110 sets a drive starting trigger with respect to the trigger register 54 described in FIG. 3. Thus, the sequential drive waveform as shown in FIG. 5 is generated to drive the segment electrode of the electro-optical panel, whereby the display of the electro-optical panel is changed.

In the case of fixed display contents, display data corresponding to the fixed display contents is previously stored in the memory 130 as shown in FIG. 18. For example, in the case of displaying a specific numeral in 7-segment display, display data corresponding to a font of the specific numeral is previously stored. Then, the processor 110 transmits the display data to the display data storage section 20 of the driver section 140, so that the display change of the electro-optical panel is realized.

In FIG. 18, for example, the temperature information acquiring section 112 acquires ambient temperature information using the temperature detecting section 160. Then, the drive waveform information output section 30 of the driver section 140 outputs drive waveform information based on the selected waveform information which is selected based on the acquired temperature information. Specifically, the processor 110 selects, from the waveform information IW1 to IWn stored in the memory 130, waveform information corresponding to the acquired temperature information. Then, the selected waveform information is transmitted to the driver section 140, and a sequential drive waveform is generated based on the waveform information, so that the electro-optical panel is driven.

By doing this, even when the ambient temperature changes, the most suitable waveform information for the temperature at that time is selected from the plurality of pieces of waveform information IW1 to IWn to drive the electro-optical panel. Accordingly, even when the ambient temperature changes, display characteristics with high quality can be maintained.

Moreover, in FIG. 18, the display updating section 114 performs a process of updating the display of the electro-optical panel. The drive waveform information output section 30 of the driver section 140 outputs drive waveform information based on, for example, waveform information selected according to the length of display update time of the electro-optical panel. For example, in such a case that the display update time is long, it is probable that high display quality may not be maintained even driving the electro-optical panel using normal waveform information.

In this regard, in FIG. 18, when the display update time is long for example, waveform information stored in the memory 130 in preparation for the case where the display update time is long is selected and transmitted to the driver section 140 to drive the electro-optical panel. For example, when the display update time exceeds a predetermined threshold value, waveform information (for example, FIG. 7) for preventing screen burn, which represents the repetition of black display and white display, is selected and transmitted to the driver section 140, so that the trigger of display change is implemented. By doing this, even when the display of the electro-optical panel is not updated over a long time, driving based on the waveform information for preventing screen burn is intermittently performed. Therefore, the screen burn of the electro-optical panel and the like can be prevented.

Figure 19:
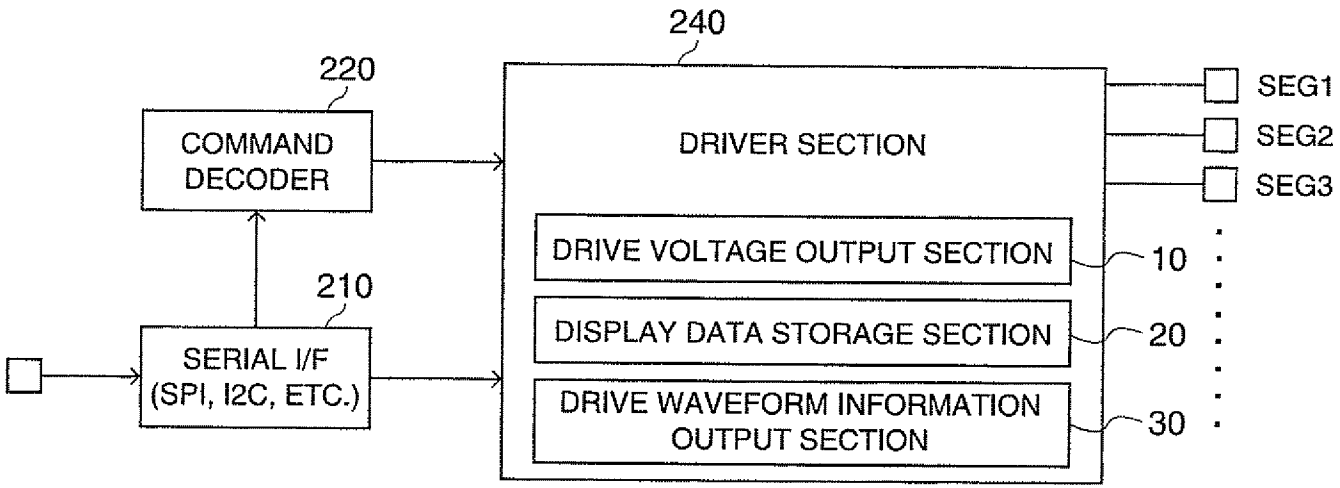
FIG. 19 shows a second modified example of the integrated circuit device of the embodiment.

FIG. 19 shows a second modified example of the integrated circuit device of the embodiment. The second modified example is an example applied to a display driver. The integrated circuit device includes a serial I/F 210, a command decoder 220, and a driver section 240. Various modifications such as omission of a part of these constituent elements and addition of other constituent elements (for example, power supply circuit, timing control section) can be made.

The serial I/F 210 is an interface for inputting various commands, display data, and waveform information from a control device such as an MPU. The command decoder 220 decodes and interprets a command issued by the control device. The driver section 240 drives segment electrode SEG1, SEG2, . . . of the electro-optical panel based on the issued command, the display data, and the waveform information. Instead of the serial I/F 210, a parallel I/F or the like may be disposed.

6. Electronic Apparatus

Figure 20:
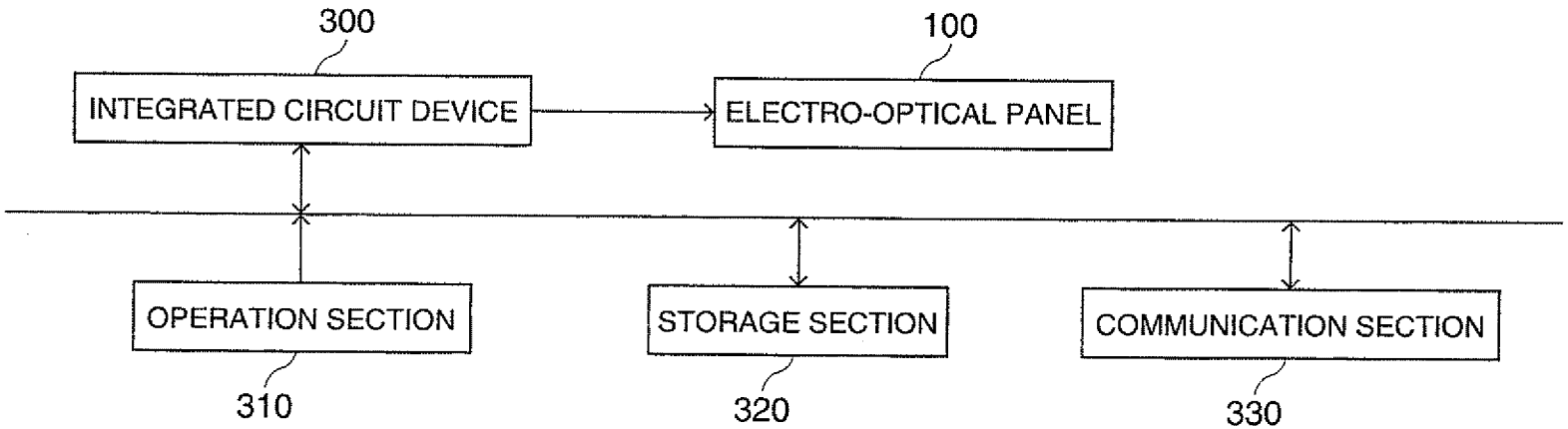
FIG. 20 shows a configuration example of an electronic apparatus of the embodiment.

FIG. 20 shows a configuration example of an electronic apparatus including an integrated circuit device 300 of the embodiment. The electronic apparatus includes the electro-optical panel 100, the integrated circuit device 300, an operation section 310, a storage section 320, and a communication section 330. Various modifications such as omission of a part of these constituent elements and addition of other constituent elements can be made.

The integrated circuit device 300 is a microcomputer or the like having a display driver or a driver function for driving the electro-optical panel 100.

The electro-optical panel 100, which displays various images (information), is an EPD panel, an ECD panel, or the like, for example. The operation section 310, which allows a user to input various pieces of information, can be realized by various buttons, a keyboard, or the like. The storage section 320, which stores various pieces of information, can be realized by a RAM, a ROM, or the like. The communication section 330 performs a communication process with respect to the outside.

Electronic apparatuses realized by the embodiment may conceivably include, for example, various apparatuses such as an electronic card (credit card, point card, etc.), an electronic paper, a remote controller, a timepiece, a mobile phone, a PDA, and a calculator.

While the embodiment has been described above in detail, those skilled in the art should readily understand that many modifications can be made without departing in substance from the novel matter and effects of the invention. Accordingly, all of those modified examples are deemed to be included in the scope of the invention. For example, throughout the specification and the drawings, any terms (EPD panel etc.) described at least once with other different terms (electro-optical panel etc.) that encompass broader meaning or are synonymous can be replaced with these different terms in any sections of the specification and the drawings. Also the configurations and operations of the integrated circuit device and the electronic apparatus are not limited to those described in the embodiment, and various modifications can be implemented.

What is claimed is:

1. An integrated circuit device comprising:

a drive voltage output section which outputs a drive voltage to be supplied to a segment electrode of an electro-optical panel;

a display data storage section which stores at least first display data and second display data; and a drive waveform information output section which outputs drive waveform information in changing of a display state at the segment electrode from a first display state corresponding to the first display data to a second display state corresponding to the second display data, wherein the drive waveform information output section has a first storage section which stores the drive waveform information for each of basic periods T1 to TM (M is an integer of 2 or more), wherein the drive waveform information includes the lengths of the periods of the each of basic periods T1 to TM according to the type, operation environments, and the like of the electro-optical panel, an output section which outputs the drive waveform information corresponding to each period specified by the basic periods T1 to TM, and the drive voltage output section outputs the drive voltage specified by the first display data and the second display data from the display data storage section and the drive waveform information from the drive waveform information output section, wherein the drive waveform information includes N×N (N is an integer of 2 or more) drive waveform signals SWV (1, 1) to SWV (N, N), the first storage section has registers RT1 to RTM (M is an integer of 2 or more) corresponding to the basic periods T1 to TM, respectively, and the register RTk (1≤k≤M) of the registers RT1 to RTM stores a register value specifying signal levels of the drive waveform signals SWV (1, 1) to SWV (N, N) in the basic period Tk of the basic periods T1 to TM.

2. An integrated circuit device comprising:

a drive voltage output section which outputs a drive voltage to be supplied to a segment electrode of an electro-optical panel;

a display data storage section which stores at least first display data and second display data; and a drive waveform information output section which outputs drive waveform information in changing of a display state at the segment electrode from a first display state corresponding to the first display data to a second display state corresponding to the second display data, wherein the drive waveform information output section includes:

a first storage section which stores the drive waveform information for each of basic periods T1 to TM (M is an integer of 2 or more), wherein the drive waveform information includes the lengths of the periods of the each of basic periods T1 to TM according to the type, operation environments, and the like of the electro-optical panel, a second storage section which stores a first designated period where a starting period and an ending period in the basic periods T1 to TM are designated and a first number of times of repetition of the first designated period, and an output section which outputs the drive waveform information corresponding to each period specified by the basic periods T1 to TM, the first designated period, and the first number of times of repetition, and the drive voltage output section outputs the drive voltage specified by the first display data and the second display data from the display data storage section and the drive waveform information from the drive waveform information output section, wherein the drive waveform information includes N×N (N is an integer of 2 or more) drive waveform signals SWV (1, 1) to SWV (N, N), the first storage section has registers RT1 to RTM (M is an integer of 2 or more) corresponding to the basic periods T1 to TM, respectively, the register RTk (1≤k≤M) of the registers RT1 to RTM stores a register value specifying signal levels of the drive waveform signals SWV (1, 1) to SWV (N, N) in the basic period Tk of the basic periods T1 to TM, and the second storage section stores, as the first designated period, a starting period and an ending period of the basic periods T1 to TM.

3. The integrated circuit device according to claim 2, wherein the second storage section has a first register which stores the starting period, a second register which stores the ending period, and a third register which stores the first number of times of repetition.

4. The integrated circuit device according to claim 2, wherein the second storage section has a first register which stores the starting period and the ending period and a second register which stores the first number of times of repetition, and the first register has an area for storing information of first and second bit strings, the first bit string corresponding to the starting period, the second bit string corresponding to the ending period.

5. The integrated circuit device according to claim 2, wherein the second storage section is disposed in the registers RT1 to RTM, and the register RTk ($1 \leq k \leq M$) of the registers RT1 to RTM has an area for storing the register value specifying the signal levels, the starting period and the ending period of the basic periods T1 to TM indicating the first designated period, and the first number of times of repetition.

6. The integrated circuit device according to claim 5, wherein the register RTk has an area for storing information of first to third bit strings, the first bit string corresponding to the register value specifying the signal levels, the second bit string corresponding to the first number of times of repetition, the third bit string corresponding to the starting period, and the register RTk in which the first number of times of repetition and the starting period are designated by the second and third bit strings designates the basic period Tk corresponding to the register RTk as the ending period.

7. The integrated circuit device according to claim 2, wherein the second storage section further stores a second designated period different from the first designated period and a second number of times of repetition of the second designated period, and the output section outputs the drive waveform information in each period specified by the basic periods T1 to TM, the first designated period, the first number of times of repetition, the second designated period, and the second number of times of repetition.

8. The integrated circuit device according to claim 7, wherein the second designated period is set within the first designated period, and the second designated period is repeated the second number of times of repetition in each of the first designated periods corresponding to the first number of times of repetition.

9. The integrated circuit device according to claim 7, wherein the second designated period is set within the first designated period, subtraction is performed for the second number of times of repetition stored in the second storage section every time the second designated period is repeated, and the second designated period is repeated the second number of times of repetition only within the first designated period at a first time.

10. An electronic apparatus comprising:

the integrated circuit device according to claim 2; and an electro-optical panel.

* * * * *